US011201415B2

(12) United States Patent
Lee et al.

(10) Patent No.: US 11,201,415 B2
(45) Date of Patent: Dec. 14, 2021

(54) TRANSMITARRAY ANTENNA AND METHOD OF DESIGNING THE SAME

(71) Applicants: HONGIK UNIVERSITY INDUSTRY—ACADEMIA COOPERATION FOUNDATION, Seoul (KR); UNIVERSITY—INDUSTRY COOPERATION GROUP OF KYUNG HEE UNIVERSITY, Yongin-si (KR)

(72) Inventors: Jeong Hae Lee, Seoul (KR); Bomson Lee, Yongin-si (KR); Chang Hyeon Lee, Incheon (KR)

(73) Assignees: Hongik University Industry-Academia Cooperation Foundation, Seoul (KR); UNIVERSITY-INDUSTRY COOPERATION GROUP OF KYUNG HEE UNIVERSITY, Yongin-si (KR)

( * ) Notice: Subject to any disclaimer, the term of this patent is extended or adjusted under 35 U.S.C. 154(b) by 196 days.

(21) Appl. No.: 16/660,287

(22) Filed: Oct. 22, 2019

(65) Prior Publication Data

US 2020/0274254 A1 Aug. 27, 2020

(30) Foreign Application Priority Data

Feb. 26, 2019 (KR) ..... 10-2019-0022236

(51) Int. Cl.
*H01Q 21/06* (2006.01)
*H01Q 21/00* (2006.01)
*H01Q 9/04* (2006.01)

(52) U.S. Cl.
CPC ..... *H01Q 21/065* (2013.01); *H01Q 9/045* (2013.01); *H01Q 21/0087* (2013.01)

(58) Field of Classification Search
CPC .. H01Q 21/065; H01Q 21/0087; H01Q 9/045; H01Q 15/00; H01Q 15/0006; H01Q 15/148; H01Q 15/14
See application file for complete search history.

(56) References Cited

U.S. PATENT DOCUMENTS 10,080,143 B2 9/2018 Rubio
2010/0220036 A1* 9/2010 Maruyama ..... H01Q 3/46 343/912
2011/0148704 A1* 6/2011 Kim ..... H01Q 15/10 342/368

FOREIGN PATENT DOCUMENTS

JP 2010-226695 A 10/2010
JP 2018-019136 A 2/2018
(Continued)

OTHER PUBLICATIONS

Korean Patent Office, Notification of Reason for Refusal of application KR10-2019-0022236 (Translated), dated Oct. 11, 2019 (Year: 2019).*
(Continued)

*Primary Examiner* — Dameon E Levi
*Assistant Examiner* — Jennifer F Hu
(74) *Attorney, Agent, or Firm* — Sughrue Mion, PLLC

(57) ABSTRACT

The present disclosure relates to a technology for designing a transmitarray antenna based on the mode and incidence angle of feed radio waves. The transmitarray antenna according to one embodiment of the present disclosure includes a plurality of transmitting surface unit cells having different surface structures and different longitudinal lengths located in a plurality of regions, wherein the transmitting surface unit cells are arranged in a mixed manner in the regions based on the different longitudinal lengths and the phase of a transmission coefficient determined based on an input phase and an output phase based on the mode and
(Continued)

incidence angle of radio waves transmitted from a feed antenna.

10 Claims, 26 Drawing Sheets

(56) References Cited

FOREIGN PATENT DOCUMENTS

| | | | |
|---|---|---|---|
| KR | 10-2011-0070461 | A | 6/2011 |
| KR | 10-1714921 | B1 | 3/2017 |
| KR | 10-1756816 | B1 | 7/2017 |
| KR | 10-2018-0035872 | A | 4/2018 |

OTHER PUBLICATIONS

Korean Patent Office, Amendment of application KR10-2019-0022236 (Translated), dated Dec. 9, 2019 (Year: 2019).*
Korean Patent Office, Written Opinion (Translated), dated Dec. 9, 2019 (Year: 2019).*
Korean Patent Office, Written Decision (Translated), dated Jan. 21, 2020 (Year: 2020).*
English Translation of JP 2018-019136 (Year: 2018).*
Communication dated Oct. 11, 2019, issued by the Korean Patent Office in counterpart Korean Patent Application No. 10-2019-0022236.

* cited by examiner

【FIG. 1】
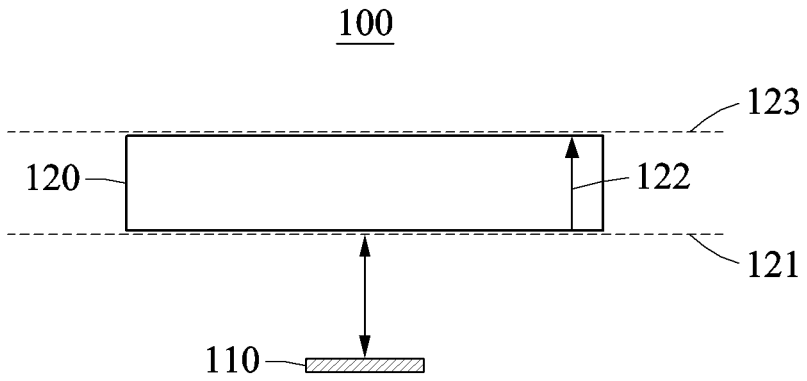

【FIG. 2A】
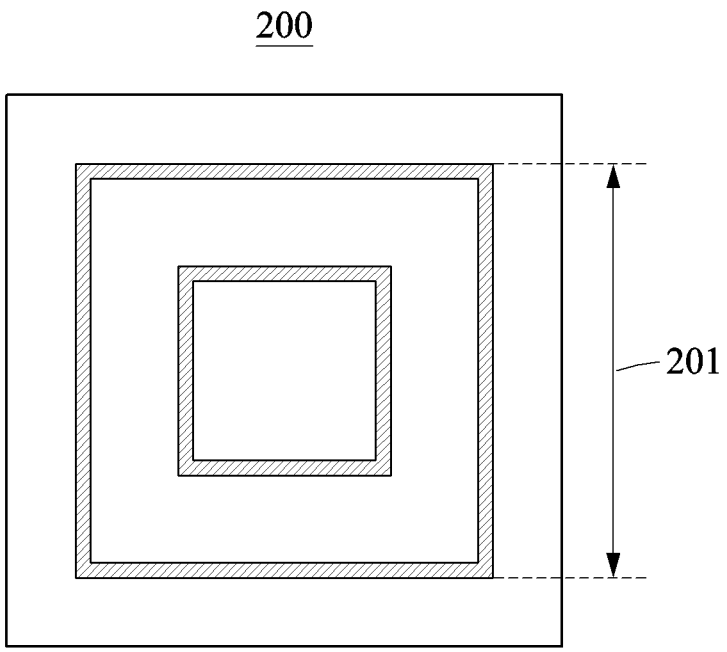

【FIG. 2B】
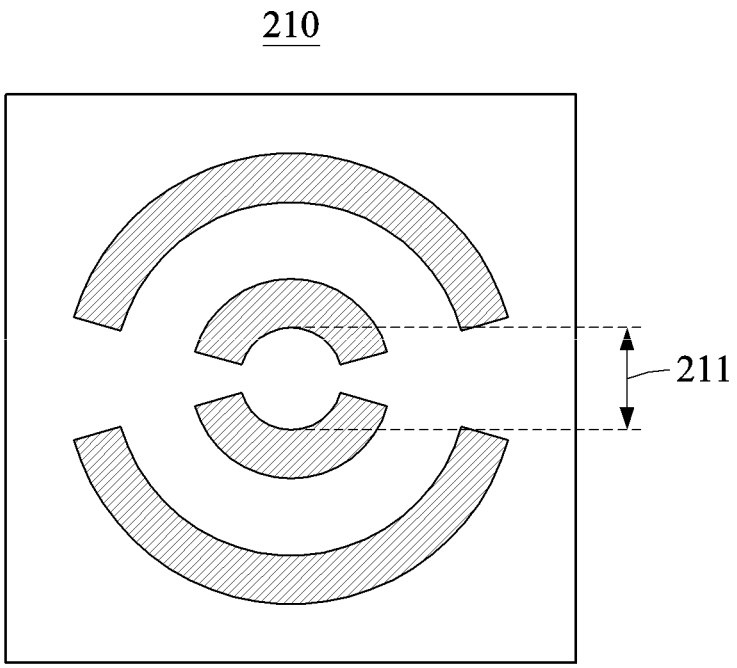

【FIG. 2C】
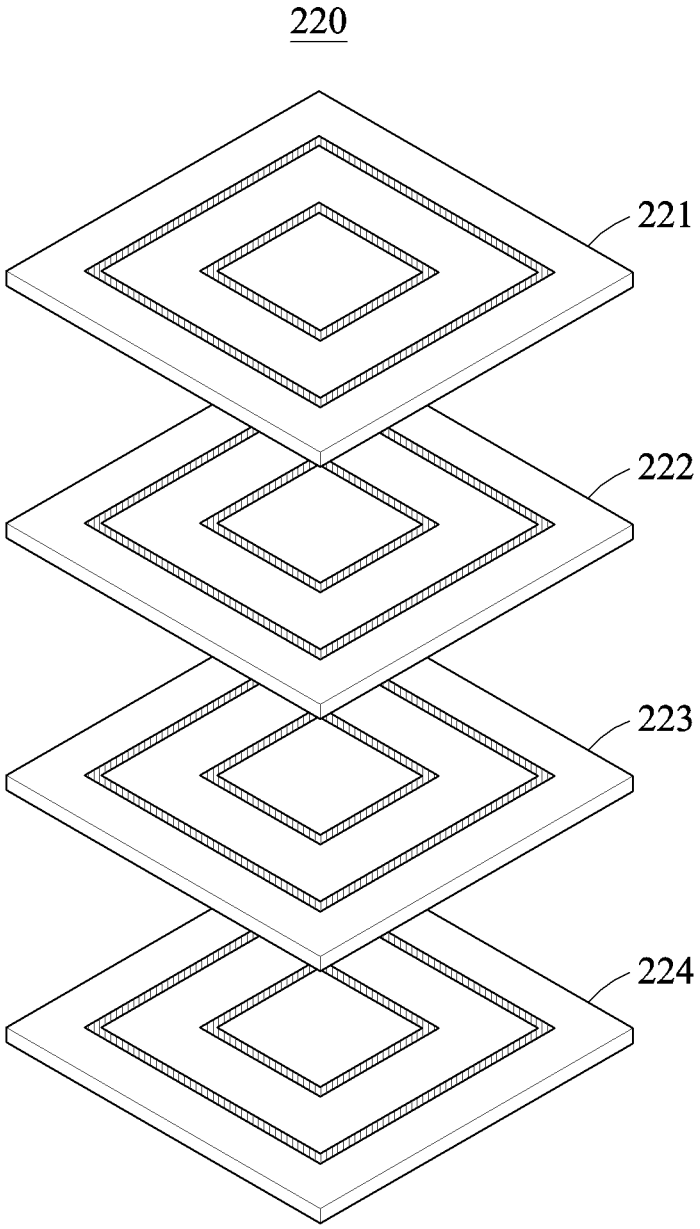

【FIG. 2D】
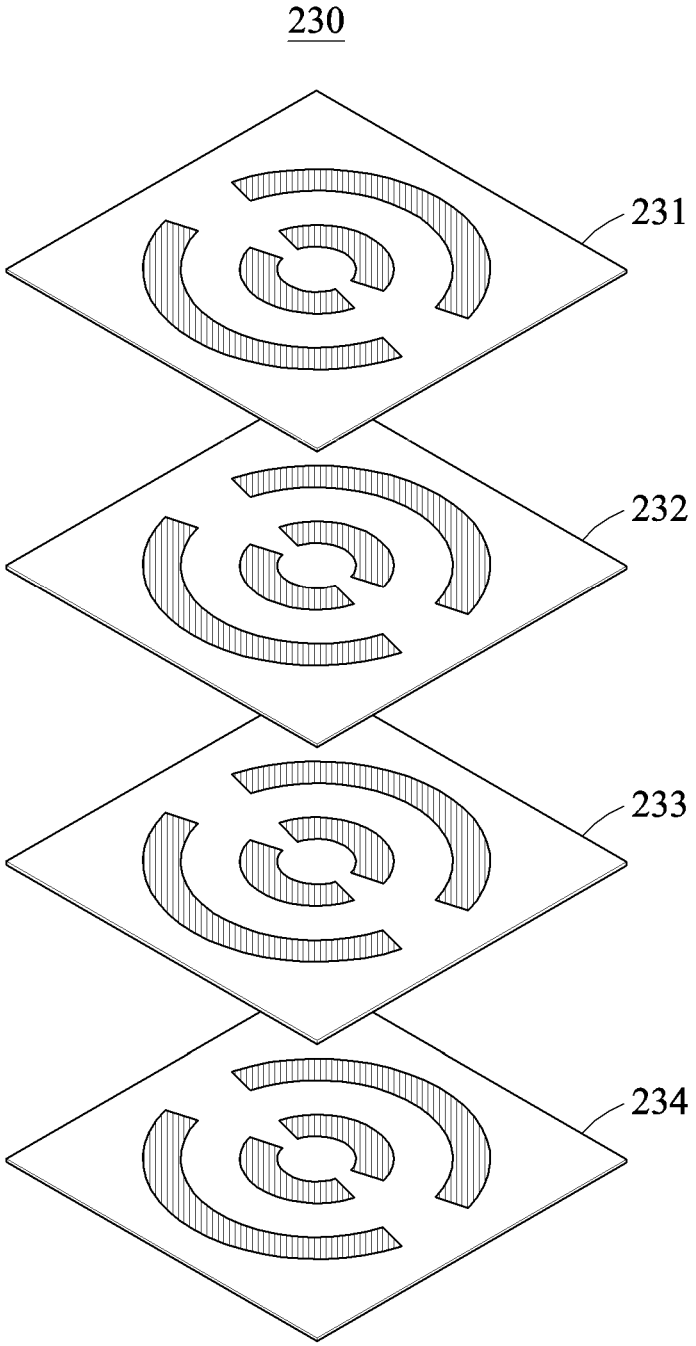

【FIG. 3A】
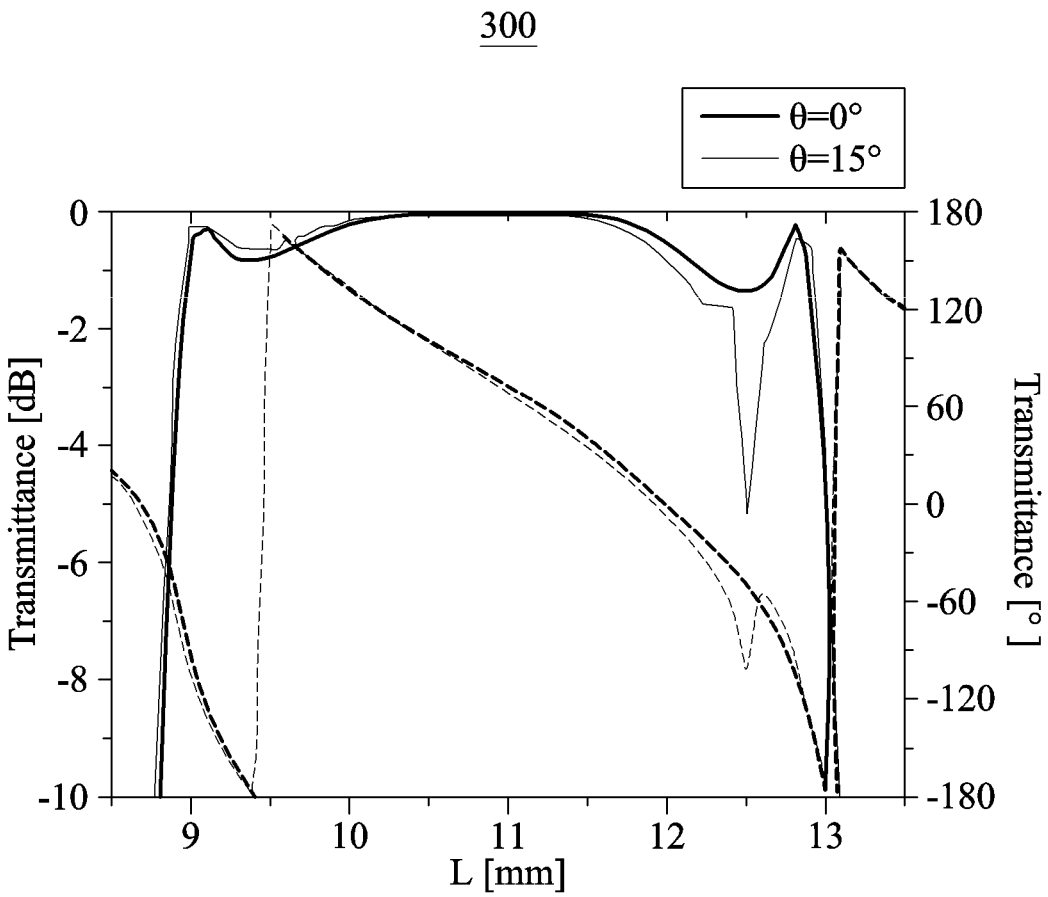

【FIG. 3B】
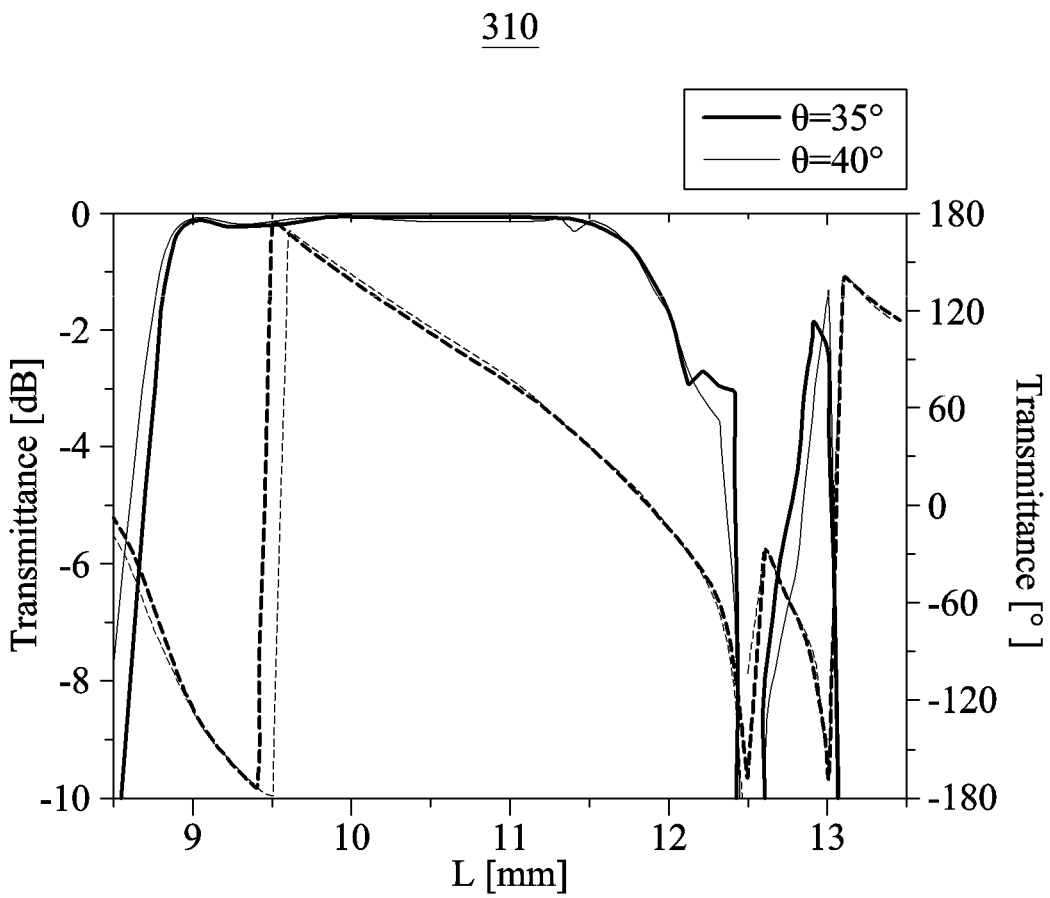

【FIG. 3C】
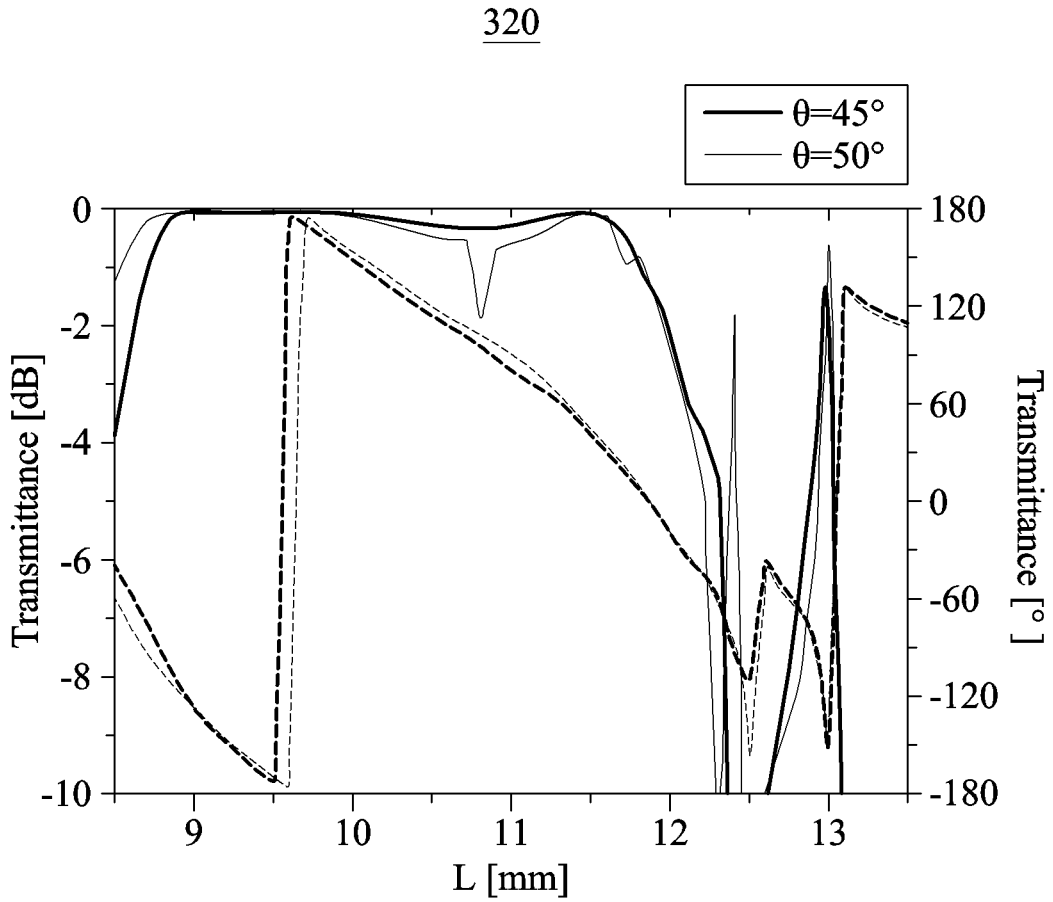

【FIG. 3D】
330
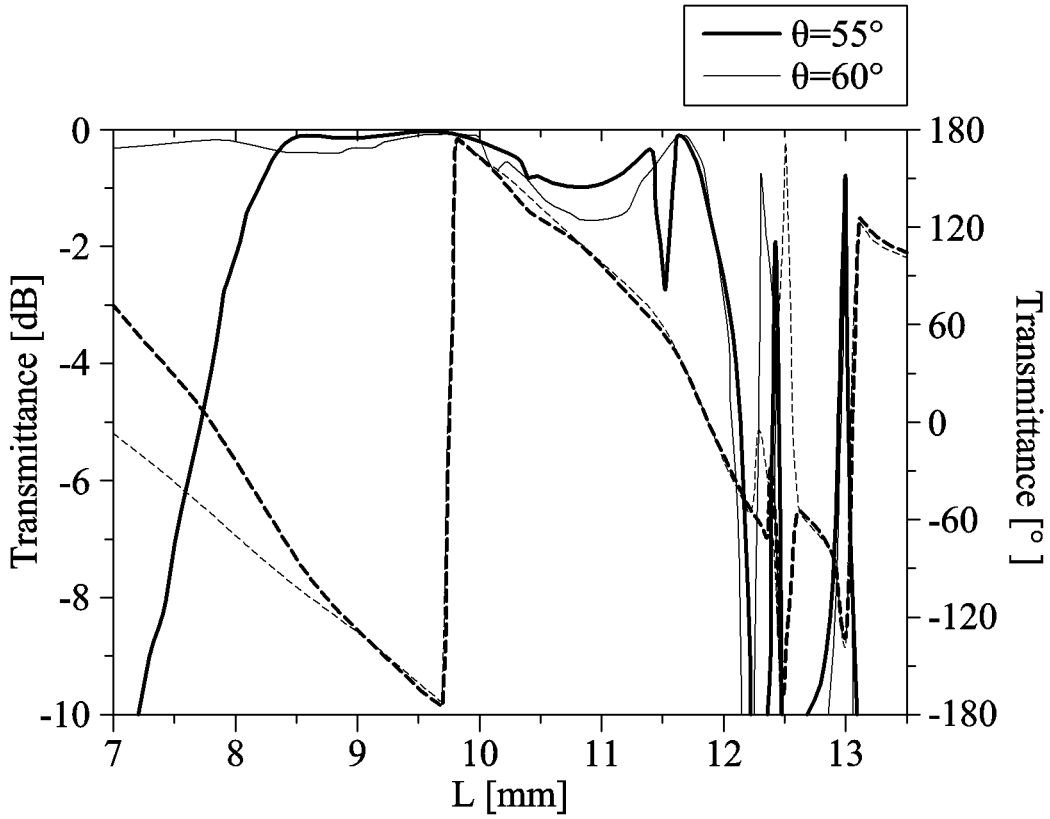

【FIG. 4A】
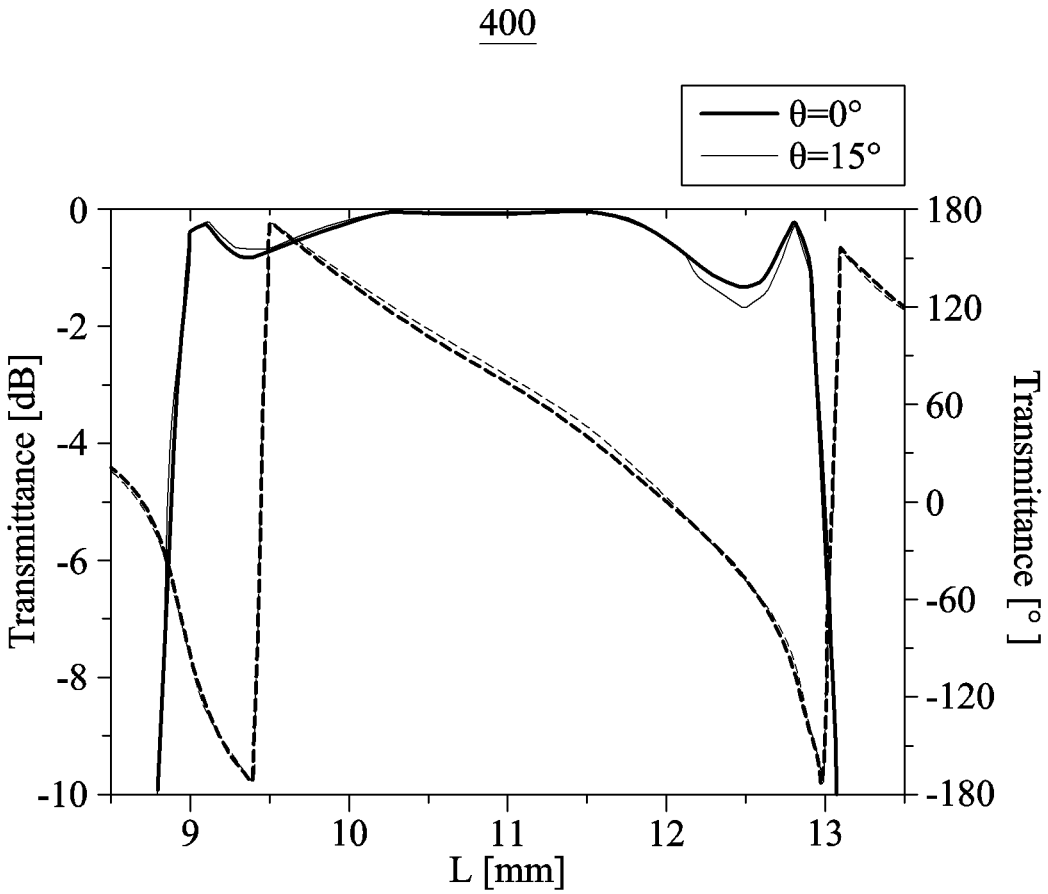

【FIG. 4B】
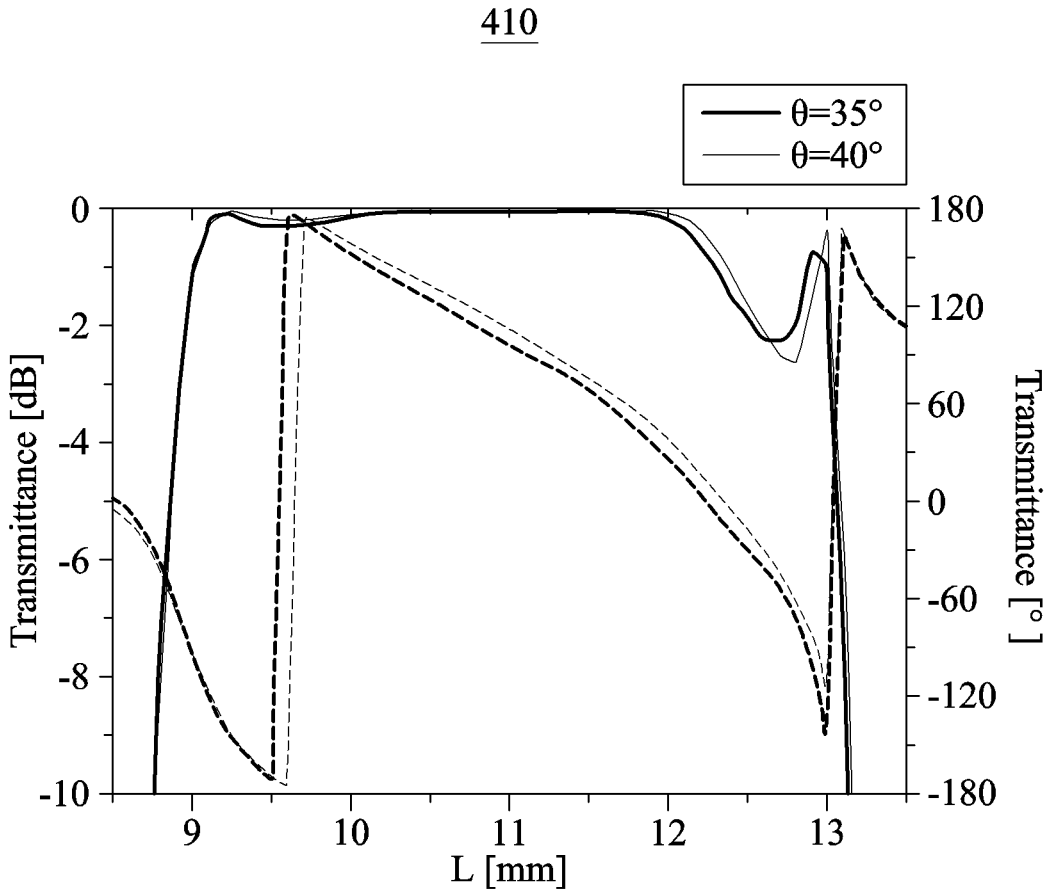

【FIG. 4C】
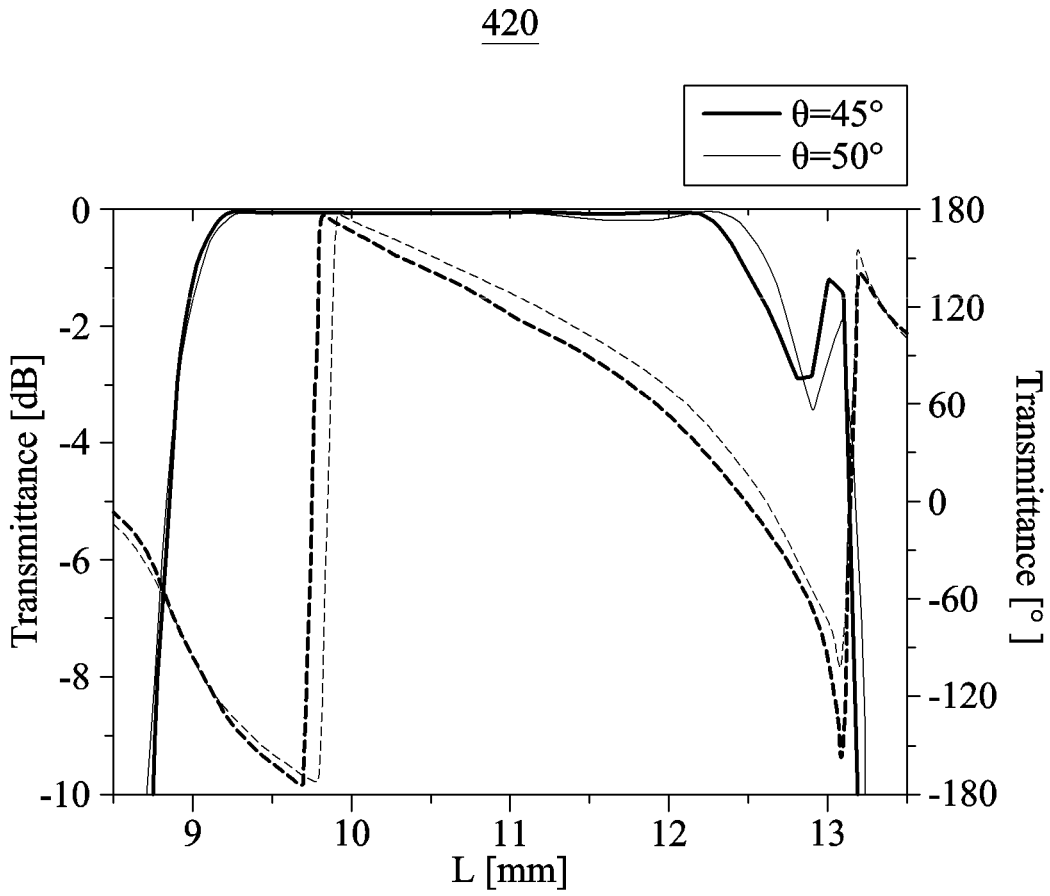

【FIG. 4D】
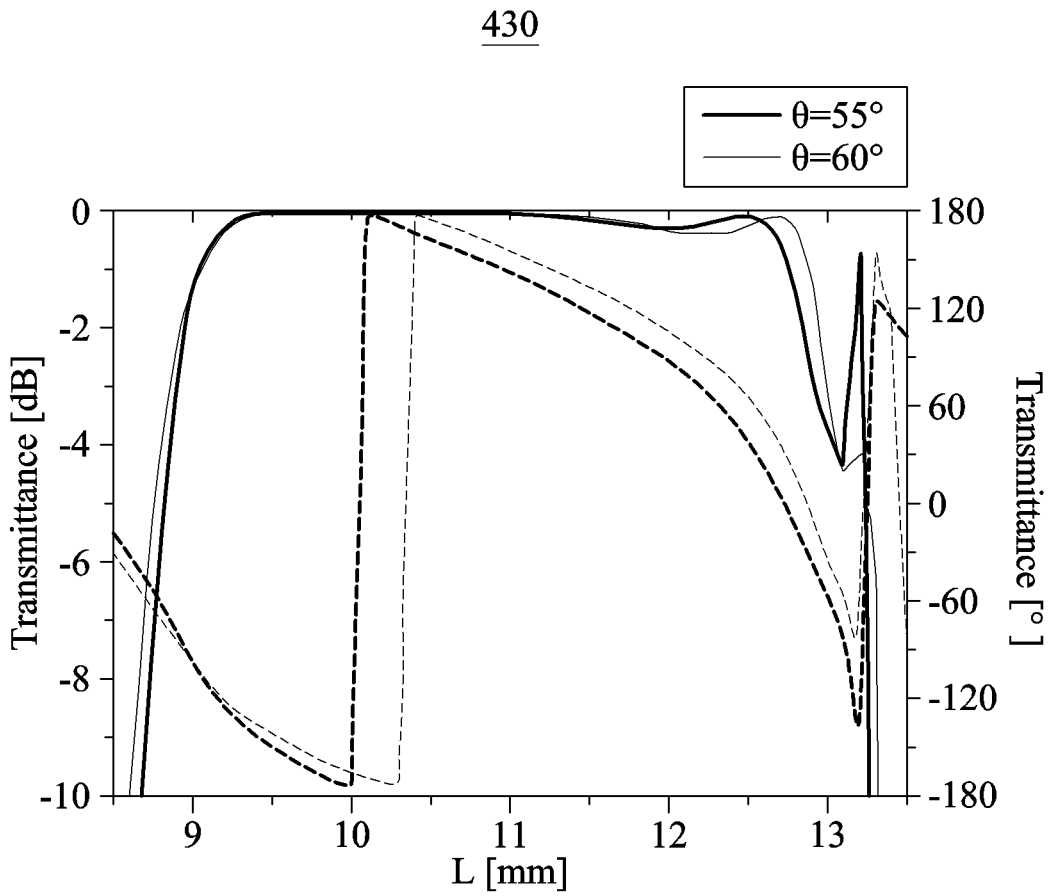

【FIG. 5A】
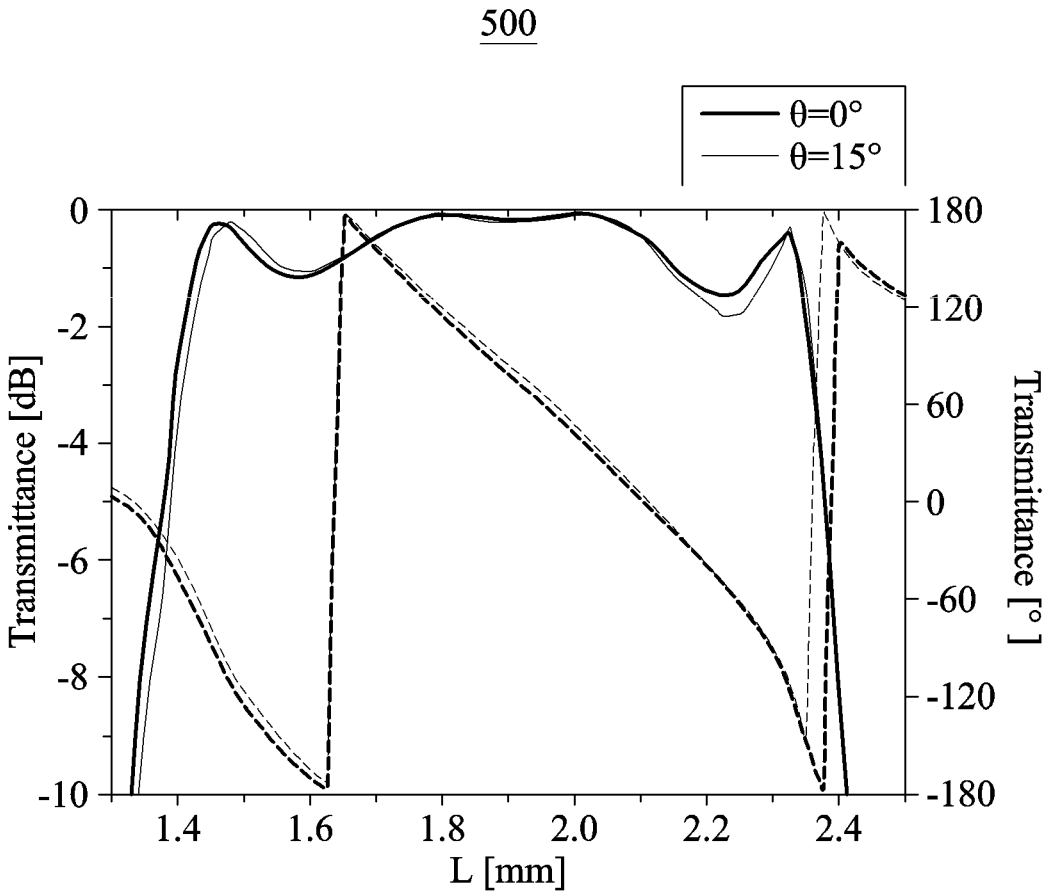

【FIG. 5B】
510
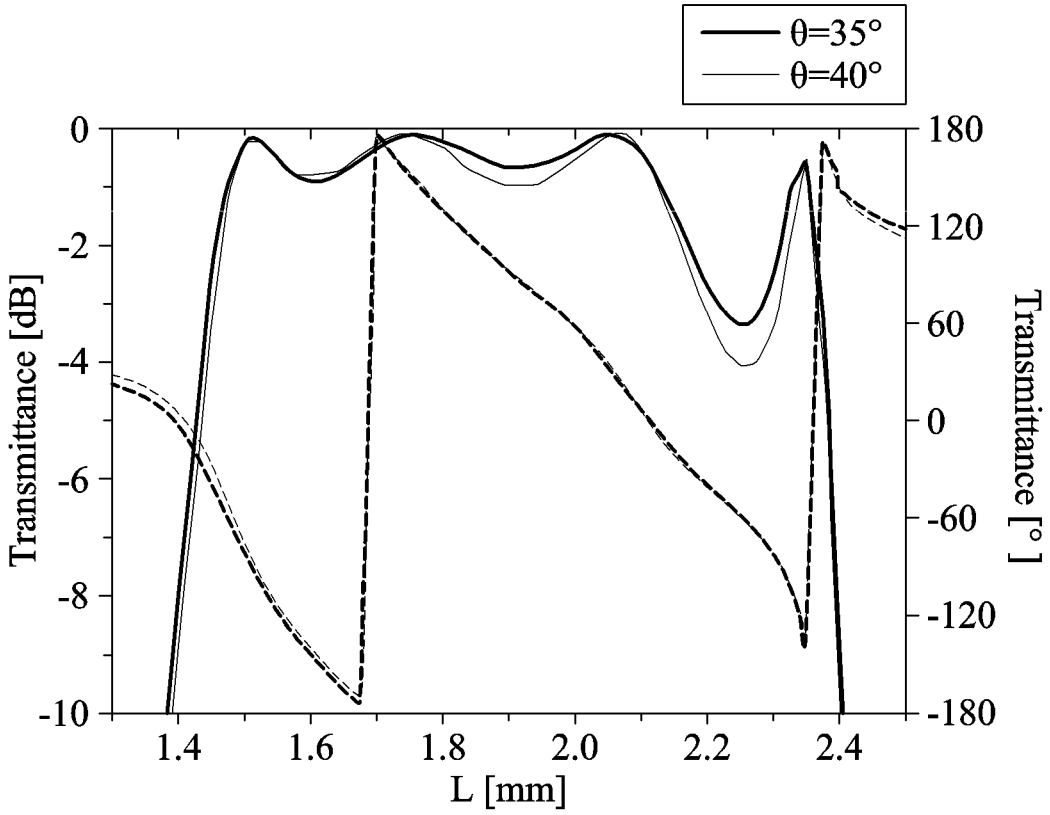

【FIG. 5C】
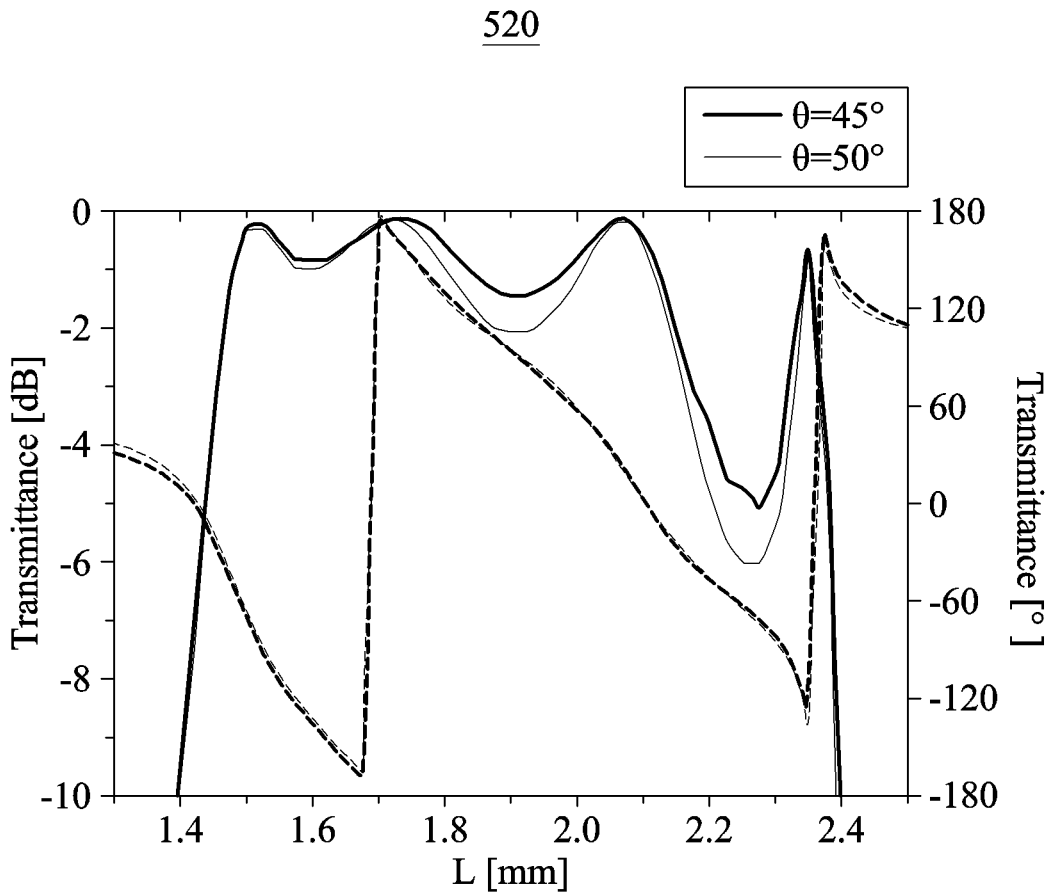

【FIG. 5D】
530
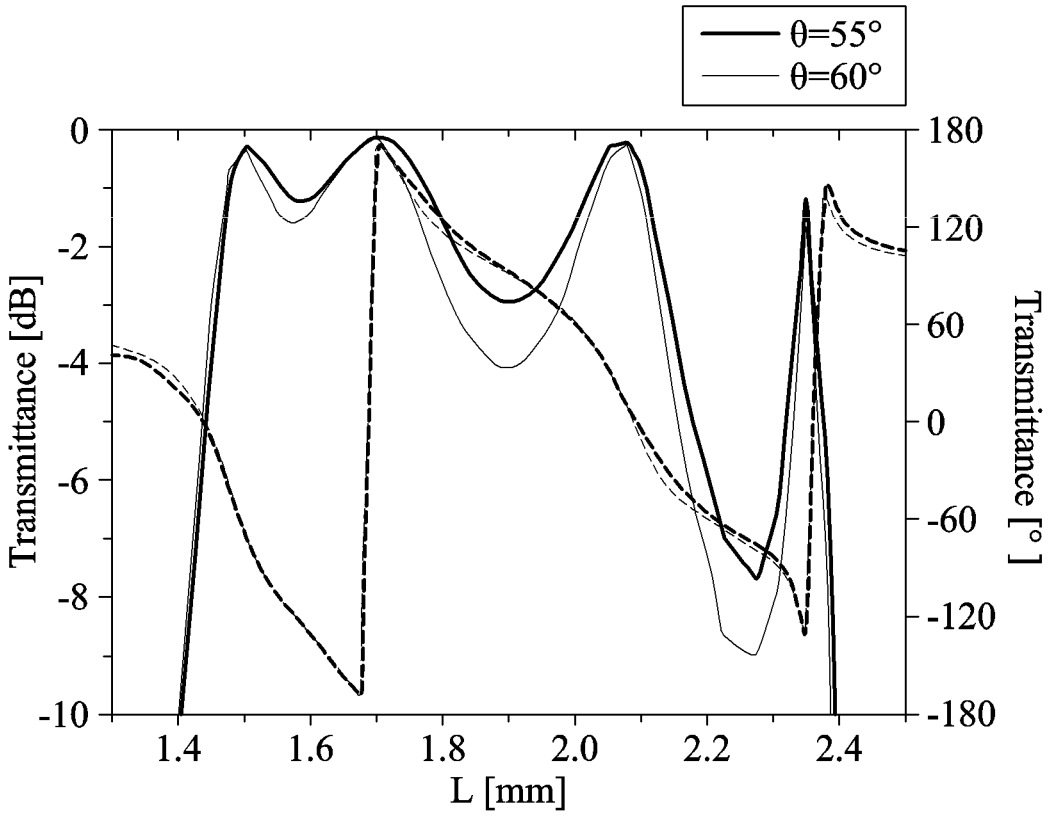

【FIG. 6A】
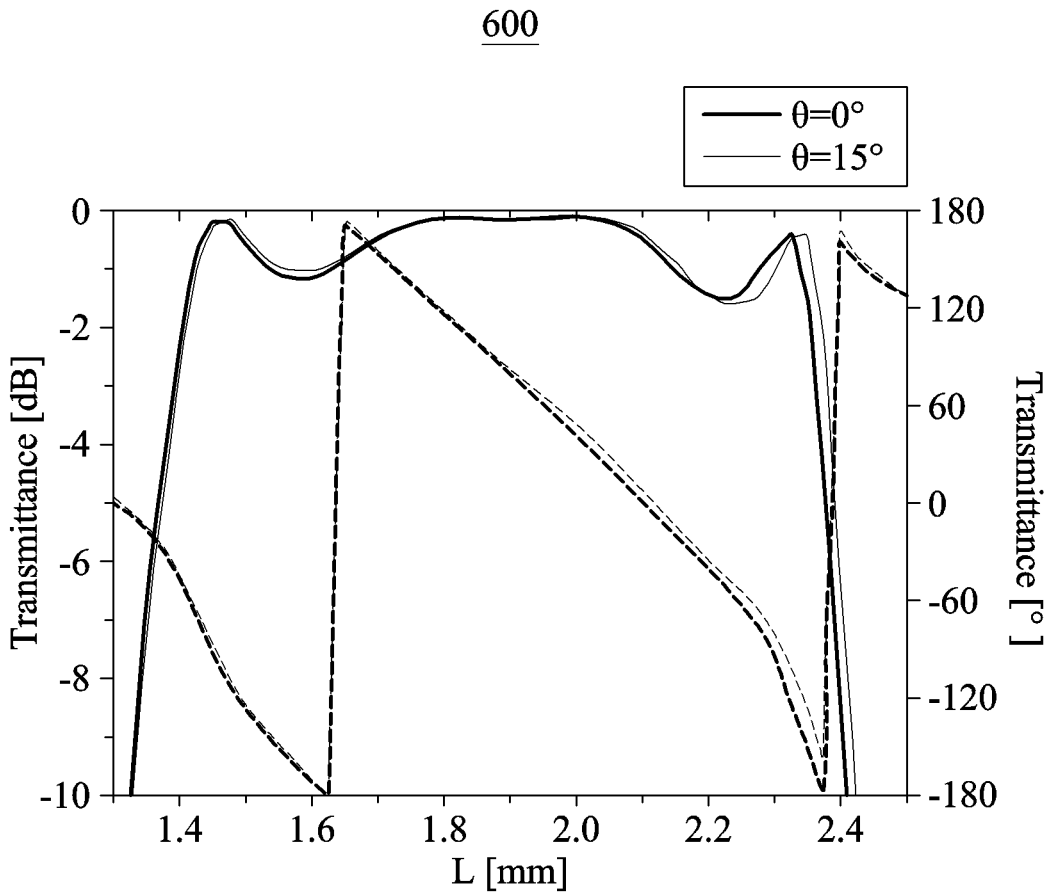

【FIG. 6B】
610
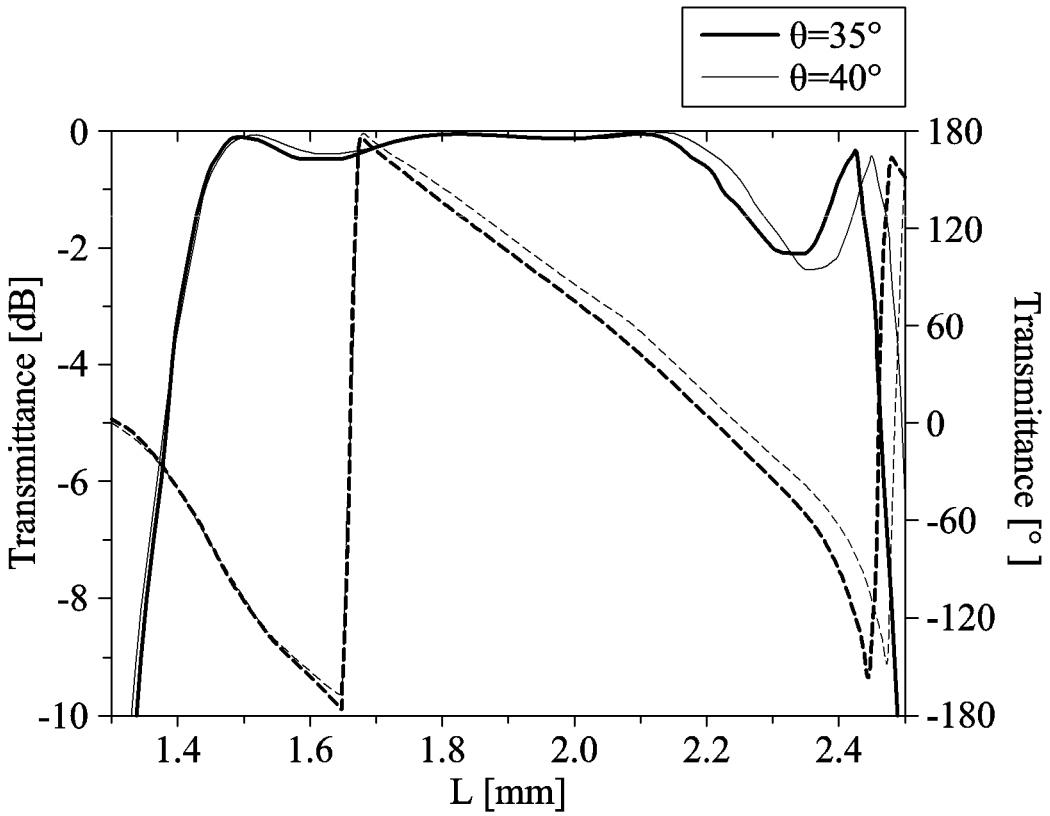

【FIG. 6C】
620
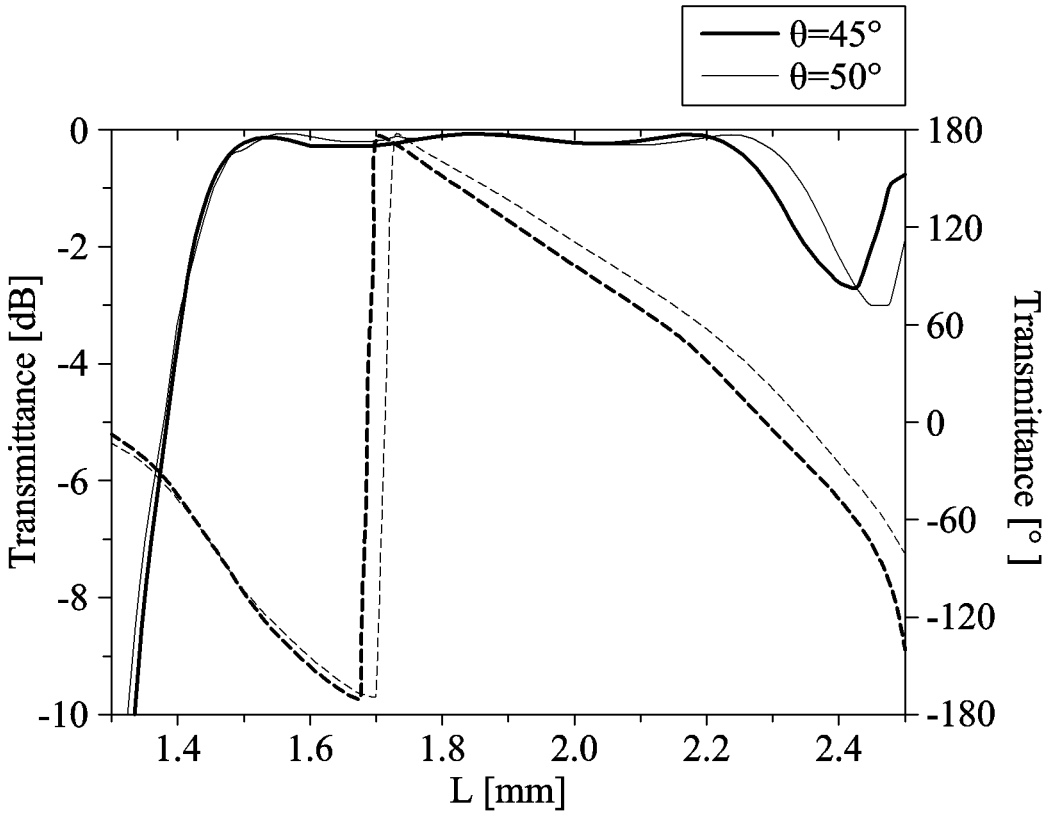

【FIG. 6D】
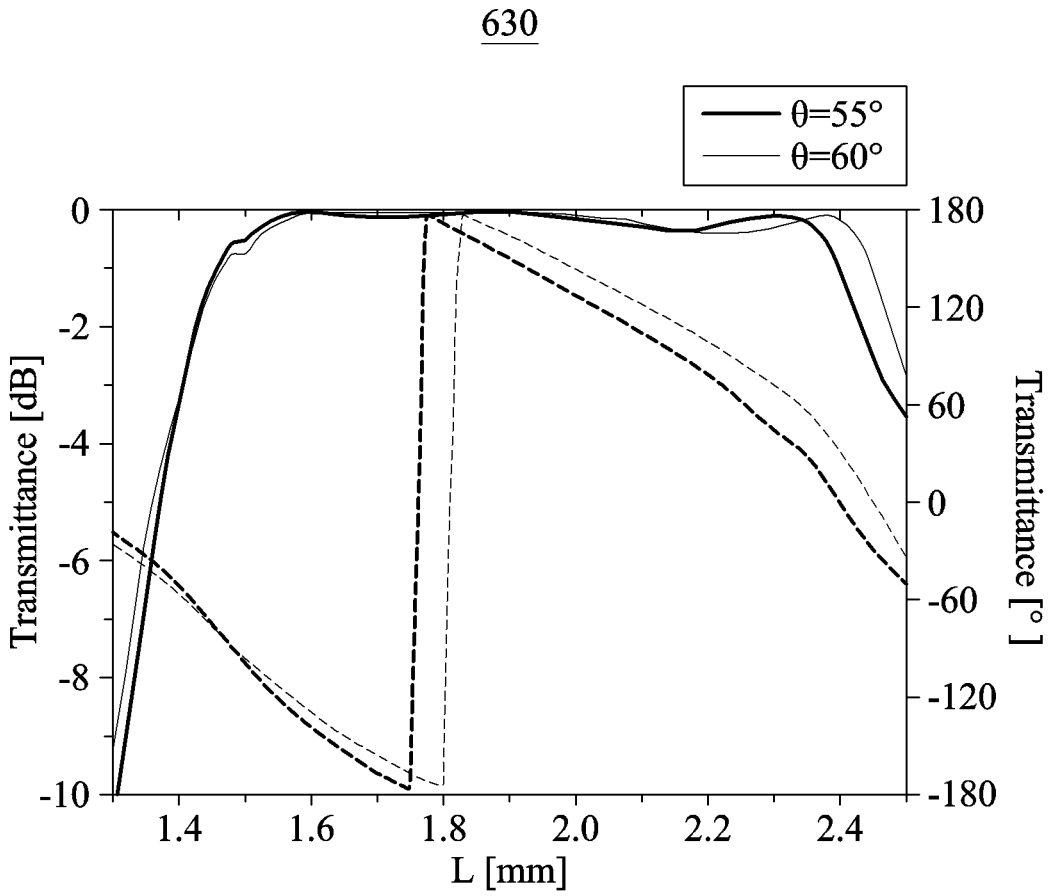

【FIG. 7】

700

TM

| | | | | | | | | | |
|---|---|---|---|---|---|---|---|---|---|
| | | | | 60 | 60 | | | | |
| | | 60 | 55 | 55 | 55 | 55 | 60 | | |
| | 60 | 55 | 50 | 45 | 45 | 50 | 55 | 60 | |
| TE | 55 | 50 | 40 | 35 | 35 | 40 | 50 | 55 | TE |
| 60 | 55 | 45 | 35 | 15 | 15 | 35 | 45 | 55 | 60 |
| 60 | 55 | 45 | 35 | 15 | 15 | 35 | 45 | 55 | 60 |
| | 55 | 50 | 40 | 35 | 35 | 40 | 50 | 55 | |
| | 60 | 55 | 50 | 45 | 45 | 50 | 55 | 60 | |
| | | 60 | 55 | 55 | 55 | 55 | 60 | | |
| | | | | 60 | 60 | | | | |

TM

【FIG. 8】

800

TM

| | | | | | | | | | |
|---|---|---|---|---|---|---|---|---|---|
| | | | | 155 | 161 | | | | |
| | | 134 | 52 | 8 | 6 | 55 | 133 | | |
| | 135 | 17 | 284 | 233 | 233 | 284 | 17 | 136 | |
| TE | 62 | 293 | 189 | 128 | 128 | 190 | 293 | 60 | TE |
| 171 | 20 | 245 | 136 | 70 | 70 | 135 | 245 | 19 | 171 |
| 171 | 20 | 245 | 135 | 69 | 69 | 134 | 245 | 20 | 171 |
| | 61 | 294 | 188 | 128 | 128 | 189 | 293 | 62 | |
| | 136 | 19 | 284 | 233 | 233 | 285 | 18 | 137 | |
| | | 134 | 54 | 11 | 11 | 53 | 134 | | |
| | | | | 163 | 164 | | | | |

TM

【FIG. 9A】
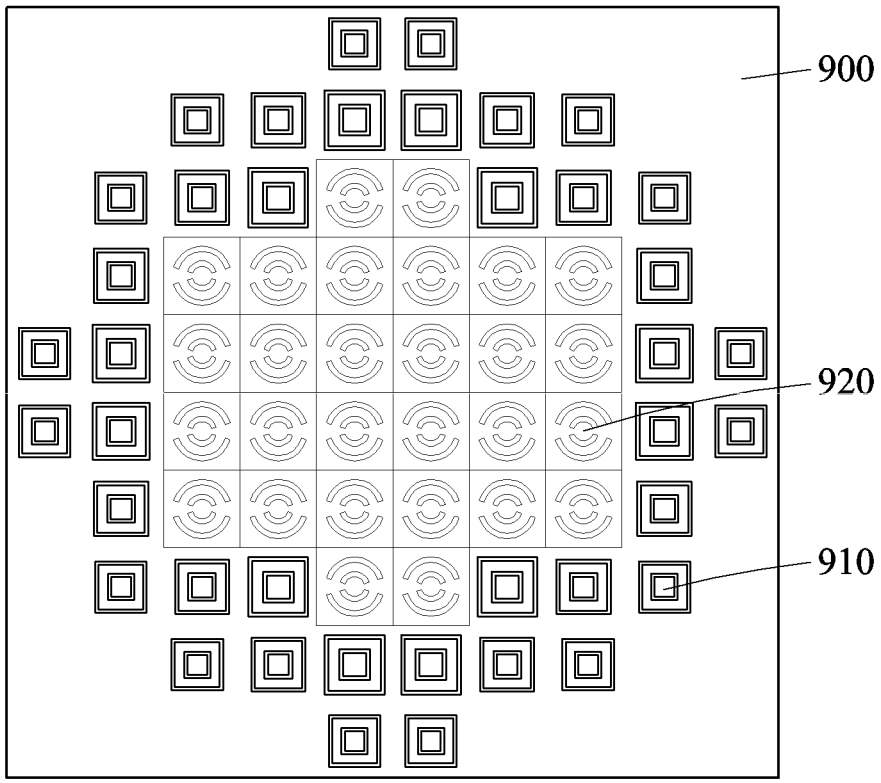

【FIG. 9B】
930
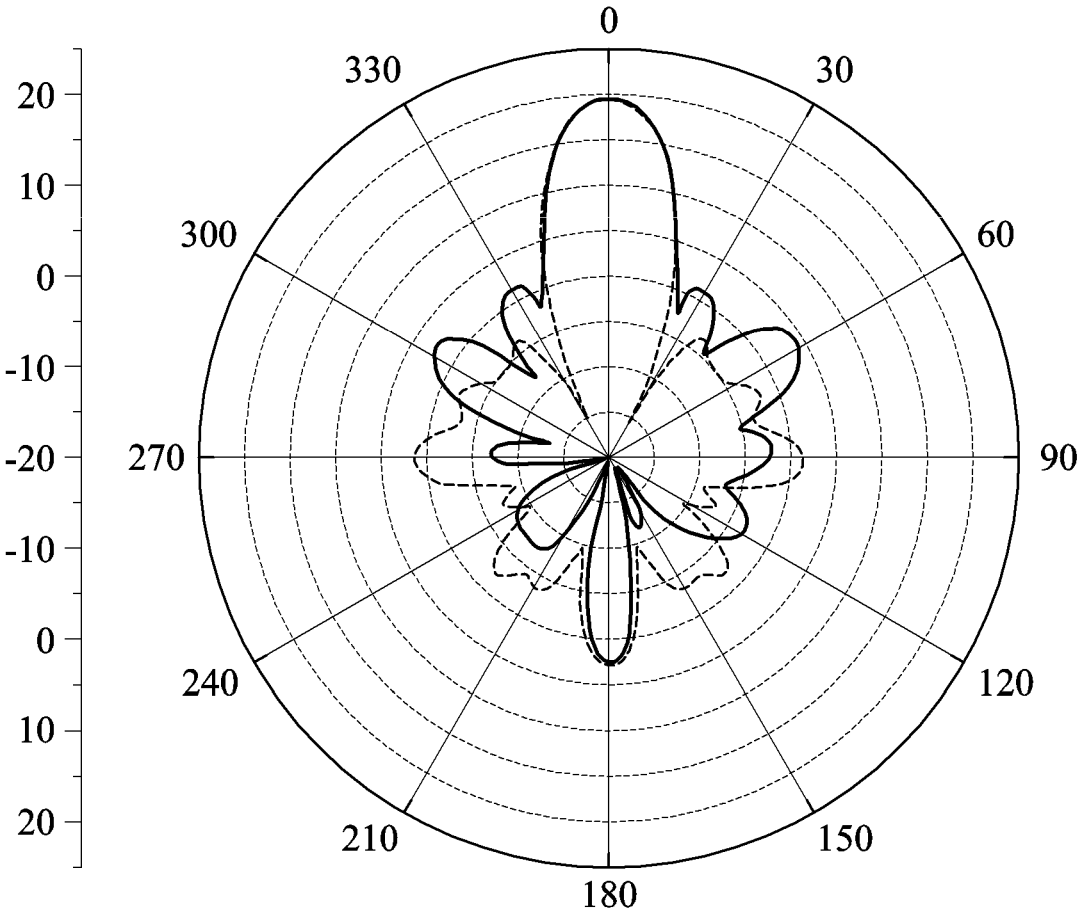

【FIG. 10】
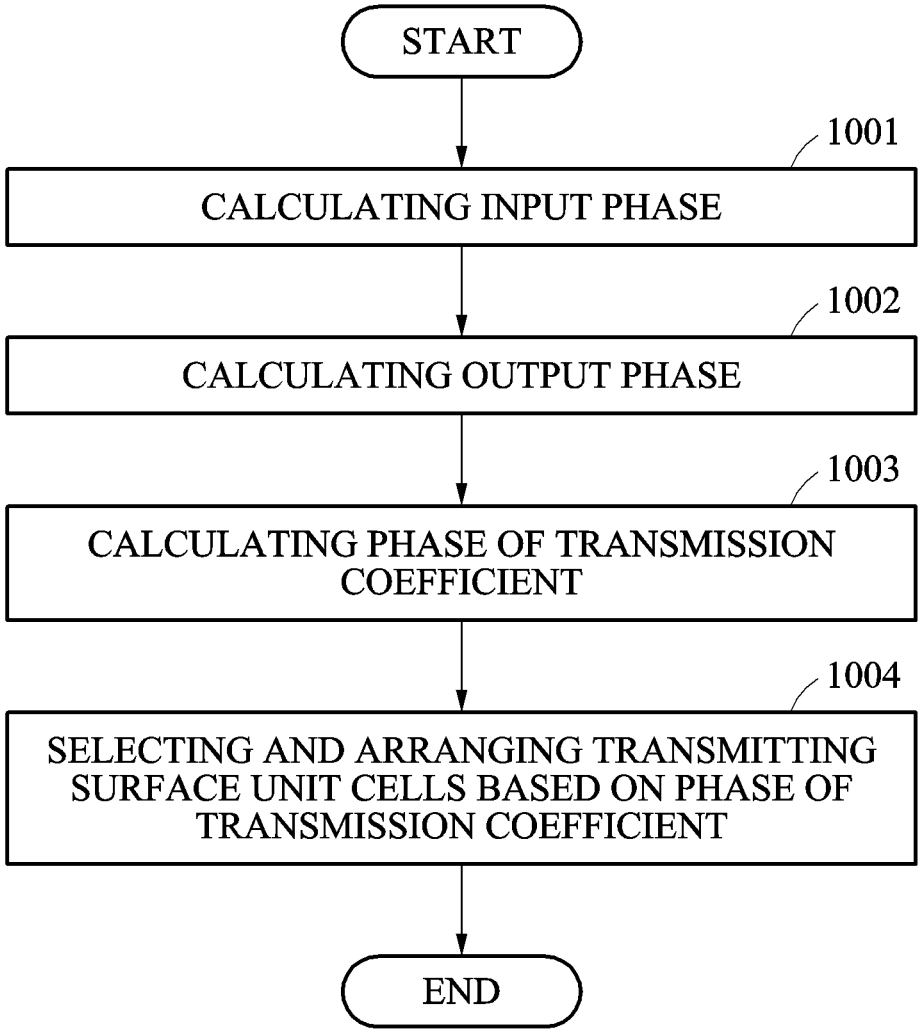

TRANSMITARRAY ANTENNA AND METHOD OF DESIGNING THE SAME

CROSS-REFERENCE TO RELATED APPLICATION

This application claims priority to Korean Patent Application No. 10-2019-0022236, filed on Feb. 26, 2019 in the Korean Intellectual Property Office, the disclosure of which is incorporated herein by reference.

BACKGROUND OF THE DISCLOSURE

Field of the Disclosure

The present disclosure relates to a technology for designing a transmitarray antenna based on the mode and incidence angle of feed radio waves. More particularly, the present disclosure relates to a technology for designing a transmitting surface of a transmitarray antenna using a plurality of transmitting surface unit cells having different shapes on the basis of change in the characteristics of the transmitting surface of the transmitarray antenna according to the mode and incidence angle of feed radio waves. According to the present disclosure, the transmission efficiency of a transmitarray antenna may be improved.

Description of the Related Art

According to the related art, in the case of transmitarray antennas, since loss occurring in a feeder is relatively small, the transmitarray antennas can be applied to satellites, radars, and the like requiring a high-gain antenna having a gain of 20 dB or more.

In addition, a transmitarray antenna has a plurality of unit structure cells arranged on the transmitting surface thereof, and thus can receive radio waves from a feed antenna.

In addition, when the distance between the transmitting surface of a transmitarray antenna and a feed antenna is close, and when feed radio waves are incident on the transmitting surface at a large angle from the feed antenna, the efficiency of the transmitarray antenna may be reduced due to change in the characteristics of the transmitting surface.

That is, when the incidence angle of radio waves incident on the transmitting surface is large, performance of the transmitting surface may be deteriorated.

Accordingly, according to the related art, a transmitarray antenna is designed so that a feed antenna and the transmitting surface of the transmitarray antenna are spaced apart by a sufficient distance to minimize the incidence angle of feed radio waves.

Therefore, compared with the conventional array antennas, the transmitarray antennas according to the related art have a disadvantage that the overall size thereof is large.

RELATED DOCUMENTS

Patent Documents

Korean Patent Application Publication No. 10-2018-0035872, "BROADBAND ARRAY ANTENNA"

U.S. Pat. No. 10,080,143, "METHOD OF PLACING AN ANTENNA OF A RADIO ACCESS NETWORK (RAN) ASSET IN A WIRELESS COMMUNICATION NETWORK"

Korean Patent No. 10-1756816, "BAND STOP OPERATION FREQUENCY SELECTION SURFACE STRUCTURE HAVING REPEATED ARRAYS OF MINIATURIZED UNIT STRUCTURE"

Korean Patent No. 10-1714921, "MULTIBAND ABSORBER USING META-MATERIAL"

SUMMARY OF THE DISCLOSURE

Therefore, the present disclosure has been made in view of the above problems, and it is an object of the present disclosure to provide a technology for mixing and arranging transmitting surface unit cells having different characteristics in accordance with change in the characteristics of a transmitting surface depending on the mode and incidence angle of feed radio waves.

It is another object of the present disclosure to provide a method of designing a low-profile transmitarray antenna. According to the present disclosure, when a low-profile transmitarray antenna is designed, performance degradation of transmitting surface unit cells located in the transmitting surface of a transmitarray antenna depending on the mode and incidence angle of feed radio waves may be prevented, thereby improving the efficiency of the transmitarray antenna.

It is still another object of the present disclosure to improve the radiation efficiency of a transmitarray antenna by selecting transmitting surface unit cells having excellent performance with respect to the incident characteristics of feed radio waves among transmitting surface unit cells having different characteristics or longitudinal lengths and by arranging the selected transmitting surface unit cells in a mixed manner.

It is yet another object of the present disclosure to increase the efficiency of a transmitarray antenna while reducing the overall size of the antenna by selectively arranging a plurality of transmitting surface unit cells having different characteristics or longitudinal lengths.

In accordance with one aspect of the present disclosure, provided is a transmitarray antenna including a plurality of transmitting surface unit cells having different surface structures and different longitudinal lengths located in a plurality of regions, wherein the transmitting surface unit cells are arranged in a mixed manner in the regions based on the different longitudinal lengths and the phase of a transmission coefficient determined based on an input phase and an output phase based on the mode and incidence angle of radio waves transmitted from a feed antenna.

Any one of the transmitting surface unit cells may be selectively arranged in any one of the regions based on the magnitude and phase of a transmission coefficient depending on the mode and incidence angle of radio waves transmitted from the feed antenna.

The transmitting surface unit cells may be arranged in a mixed manner in a multilayer or single-layer form based on the mode and incidence angle of radio waves incident on the regions from the feed antenna.

The phase of the transmission coefficient may be calculated based on the combination of the output phase and the negative value of the input phase.

The mode of radio waves may include a transverse electric (TE) mode or a transverse magnetic (TM) mode.

When any one of the transmitting surface unit cells has an incidence angle of 0° to 60° in the transverse electric (TE) mode, a transmission coefficient of −0.13 dB to −2.44 dB may be exhibited depending on the phase of the transmission coefficient. When any one of the transmitting surface unit cells has an incidence angle of 0° to 60° in the transverse magnetic (TM) mode, a transmission coefficient of −0.03 dB to −2.87 dB may be exhibited depending on the phase of the transmission coefficient.

When any one of the transmitting surface unit cells has an incidence angle of 0° to 60° in the transverse electric (TE) mode, a transmission coefficient of −0.15 dB to −2.44 dB may be exhibited depending on the phase of the transmission coefficient. When any one of the transmitting surface unit cells has an incidence angle of 0° to 60° in the transverse magnetic (TM) mode, a transmission coefficient of −0.06 dB to −1.61 dB may be exhibited depending on the phase of the transmission coefficient.

The incidence angle may be gradually increased from 0° to 60° from the central portion of the regions to the outer portion of the regions.

Any one of the transmitting surface unit cells may have a longitudinal length of 9 mm to 10 mm, and the other of the transmitting surface unit cells may have a longitudinal length of 1.6 mm to 1.8 mm.

In accordance with another aspect of the present disclosure, provided is a method of designing a transmitarray antenna including a step of calculating an input phase based on the mode and incidence angle of radio waves transmitted from a feed antenna; a step of calculating an output phase based on the calculated input phase; a step of calculating the phase of a transmission coefficient by combining the calculated output phase and the negative value of the calculated input phase; and a step of selecting a plurality of transmitting surface unit cells having different surface structures and different longitudinal lengths and arranging the selected transmitting surface unit cells in a mixed manner in the regions based on the calculated phase of a transmission coefficient.

The step of arranging may include a step of arranging transmitting surface unit cells having a longitudinal length shorter than a reference length among the transmitting surface unit cells in a central portion of the regions based on the calculated phase of a transmission coefficient; and a step of arranging transmitting surface unit cells having a longitudinal length longer than a reference length among the transmitting surface unit cells in an outer portion of the regions based on the calculated phase of a transmission coefficient.

The step of arranging may include a step of selecting any one of the transmitting surface unit cells according to the calculated phase of a transmission coefficient and a magnitude of a transmission coefficient based on the different longitudinal lengths and arranging the selected transmitting surface unit cell in a mixed manner in the regions.

BRIEF DESCRIPTION OF THE DRAWINGS

The above and other objects, features and other advantages of the present disclosure will be more clearly understood from the following detailed description taken in conjunction with the accompanying drawings, in which:

FIG. 1 is a drawing for explaining operation of a transmitarray antenna according to one embodiment of the present disclosure;

FIGS. 2A to 2D are drawings for explaining the structures of the transmitting surface unit cells of a transmitarray antenna according to one embodiment of the present disclosure;

FIGS. 3A to 3D are graphs showing the magnitude and phase of a transmission coefficient depending on an incidence angle when feed radio waves are incident on first-type transmitting surface unit cells according to one embodiment of the present disclosure at an oblique angle in a TE mode;

FIGS. 4A to 4D are graphs showing the magnitude and phase of a transmission coefficient depending on an incidence angle when feed radio waves are incident on first-type transmitting surface unit cells according to one embodiment of the present disclosure at an oblique angle in a TM mode;

FIGS. 5A to 5D are graphs showing the magnitude and phase of a transmission coefficient depending on an incidence angle when feed radio waves are incident on second-type transmitting surface unit cells according to one embodiment of the present disclosure at an oblique angle in a TE mode;

FIGS. 6A to 6D are graphs showing the magnitude and phase of a transmission coefficient depending on an incidence angle when feed radio waves are incident on second-type transmitting surface unit cells according to one embodiment of the present disclosure at an oblique angle in a TM mode;

FIG. 7 is a drawing for explaining incidence angles in transmitting surface unit cells according to one embodiment of the present disclosure;

FIG. 8 is a drawing for explaining the phase of a transmission coefficient required for formation of an output phase associated with the maximum gain in transmitting surface unit cells according to one embodiment of the present disclosure;

FIG. 9A shows a design structure of a transmitarray antenna according to one embodiment of the present disclosure;

FIG. 9B is a drawing for explaining the radiation patterns of a transmitarray antenna according to one embodiment of the present disclosure; and FIG. 10 is a flowchart for explaining a method of designing a transmitarray antenna according to one embodiment of the present disclosure.

DETAILED DESCRIPTION OF THE DISCLOSURE

Specific structural and functional descriptions of embodiments according to the concept of the present disclosure disclosed herein are merely illustrative for the purpose of explaining the embodiments according to the concept of the present disclosure. Furthermore, the embodiments according to the concept of the present disclosure can be implemented in various forms and the present disclosure is not limited to the embodiments described herein.

The embodiments according to the concept of the present disclosure may be implemented in various forms as various modifications may be made. The embodiments will be described in detail herein with reference to the drawings. However, it should be understood that the present disclosure is not limited to the embodiments according to the concept of the present disclosure, but includes changes, equivalents, or alternatives falling within the spirit and scope of the present disclosure.

The terms such as "first" and "second" are used herein merely to describe a variety of constituent elements, but the constituent elements are not limited by the terms. The terms are used only for the purpose of distinguishing one constituent element from another constituent element. For example, a first element may be termed a second element and a second element may be termed a first element without departing from the teachings of the present disclosure.

It should be understood that when an element is referred to as being "connected to" or "coupled to" another element, the element may be directly connected or coupled to the other element or intervening elements may be present. In contrast, when an element is referred to as being "directly connected to" or "directly coupled to" another element, there are no intervening elements present. Other words used to describe the relationship between elements or layers should be interpreted in a like fashion (e.g., "between," versus "directly between," "adjacent," versus "directly adjacent," etc.).

The terms used in the present specification are used to explain a specific exemplary embodiment and not to limit the present inventive concept. Singular expressions encompass plural expressions unless clearly specified otherwise in context. Also, terms such as "include" or "comprise" should be construed as denoting that a certain characteristic, number, step, operation, constituent element, component or a combination thereof exists and not as excluding the existence of or a possibility of an addition of one or more other characteristics, numbers, steps, operations, constituent elements, components or combinations thereof.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, preferred embodiments of the present disclosure will be described in detail with reference to the accompanying drawings. However, the scope of the present disclosure is not limited by these embodiments. Like reference numerals in the drawings denote like elements.

FIG. 1 is a drawing for explaining operation of a transmitarray antenna according to one embodiment of the present disclosure.

FIG. 1 illustrates a transmitarray antenna system associated with an operation structure in which a transmitarray antenna receives radio waves from a feed antenna, in accordance with one embodiment of the present disclosure.

Referring to FIG. 1, a transmitarray antenna system 100 may include a feed antenna 110 and a transmitarray antenna 120.

According to one embodiment of the present disclosure, the feed antenna 110 may be arranged to be spaced apart from the transmitarray antenna 120 by a predetermined distance, and may transmit radio waves to the transmitarray antenna 120.

For example, a low ratio of the distance between the feed antenna 110 and the transmitting surface of the transmitarray antenna 120 to the diameter of the transmitting surface may be associated with a low-profile design.

According to one embodiment of the present disclosure, the transmitarray antenna 120 may be formed of a metamaterial, and a meta surface may be formed thereon.

For example, the surface of the transmitarray antenna 120 may be divided into a plurality of regions, and may include a plurality of transmitting surface unit cells having different surface structures and different longitudinal lengths in the regions.

According to one embodiment of the present disclosure, the transmitarray antenna 120 may receive radio waves from the feed antenna 110. In this case, the transmitarray antenna 120 may receive radio waves in a transverse magnetic (TM) mode or a transverse electric (TE) mode.

For example, the transmitarray antenna 120 may receive radio waves through a portion facing the feed antenna 110. In this case, the received radio waves may have an input phase 121, a phase change 122 may occur when the received radio waves pass through the transmitarray antenna 120, and the received radio waves may have an output phase 123 in accordance with the phase change 122.

For example, the phase change 122 may be associated with a plurality of transmitting surface unit cells included in the transmitarray antenna 120 and the mode and incidence angle of radio waves.

In addition, the phase change 122 may be related to the calculated phase of a transmission coefficient based on the combination of the output phase 123 and the negative value of the input phase 121.

FIGS. 2A to 2D are drawings for explaining the structures of the transmitting surface unit cells of a transmitarray antenna according to one embodiment of the present disclosure.

FIG. 2A illustrates a first-type transmitting surface unit cell arranged in a transmitarray antenna according to one embodiment of the present disclosure.

Referring to FIG. 2A, a first-type transmitting surface unit cell 200 according to one embodiment of the present disclosure may be a square having sides of about 15 mm, and a longitudinal length 201 of a structure located therein may be 9 mm to 10 mm.

For example, the first-type transmitting surface unit cells 200 may have a structure consisting of a square having sides of 15 mm and two relatively small squares located therein.

According to one embodiment of the present disclosure, in the first-type transmitting surface unit cell 200, the magnitude and phase of a transmission coefficient may be changed in accordance with the mode and incidence angle of feed radio waves based on the longitudinal length 201.

FIG. 2B illustrates a second-type transmitting surface unit cell arranged in a transmitarray antenna according to one embodiment of the present disclosure.

Referring to FIG. 2B, a second-type transmitting surface unit cell 210 according to one embodiment of the present disclosure may be a square having sides of about 15 mm, and a longitudinal length 211 of a structure located therein may be 1.6 mm to 1.8 mm.

For example, the second-type transmitting surface unit cell 210 may have a structure consisting of a square having sides of 15 mm and two relatively small ellipses located therein.

According to one embodiment of the present disclosure, in the second-type transmitting surface unit cell 210, the magnitude and phase of a transmission coefficient may be changed in accordance with the mode and incidence angle of feed radio waves based on the longitudinal length 211.

FIG. 2C illustrates a multilayer structure of first-type transmitting surface unit cells arranged in a transmitarray antenna according to one embodiment of the present disclosure.

Referring to FIG. 2C, a transmitarray antenna 220 may include a structure in which a plurality of first-type transmitting surface unit cells are laminated.

According to one embodiment of the present disclosure, a first-type transmitting surface unit cell 221, a first-type transmitting surface unit cell 222, a first-type transmitting surface unit cell 223, and a first-type transmitting surface unit cell 224 may be sequentially laminated.

FIG. 2D illustrates a multilayer structure of second-type transmitting surface unit cells arranged in a transmitarray antenna according to one embodiment of the present disclosure.

Referring to FIG. 2D, a transmitarray antenna 230 may include a structure in which a plurality of second-type transmitting surface unit cells are laminated.

According to one embodiment of the present disclosure, a second-type transmitting surface unit cell 231, a second-type transmitting surface unit cell 232, a second-type transmitting surface unit cell 233, and a second-type transmitting surface unit cell 234 may be sequentially laminated.

According to one embodiment of the present disclosure, when the first-type and second-type transmitting surface unit cells are arranged in a mixed manner in the transmitarray antenna, the transmitarray antenna may compensate for sections in which performance of each type of the unit cells deteriorates depending on the mode and incidence angle of radio waves fed from a feed antenna.

That is, a plurality of transmitting surface unit cells may be arranged in a mixed manner in a multilayer or single-layer form based on the mode and incidence angle of radio waves incident on a plurality of regions from a feed antenna.

That is, according to the present disclosure, when a low-profile transmitarray antenna is designed, performance degradation of transmitting surface unit cells located in the transmitting surface of the transmitarray antenna depending on the mode and incidence angle of feed radio waves may be prevented. Thus, the present disclosure may improve the efficiency of a transmitarray antenna.

FIGS. 3A to 3D are graphs showing the magnitude and phase of a transmission coefficient depending on an incidence angle when feed radio waves are incident on first-type transmitting surface unit cells according to one embodiment of the present disclosure at an oblique angle in a TE mode.

Referring to FIG. 3A, Graph 300 shows the magnitude and phase of a transmission coefficient when feed radio waves are incident on the first-type transmitting surface unit cells at 0° or 15° in a TE mode.

For example, in Graph 300, the solid lines may represent changes in the magnitude of a transmission coefficient depending on the longitudinal length of the first-type transmitting surface unit cells for radio waves incident at 0° or 15° in a TE mode.

In addition, in Graph 300, the dotted lines may represent changes in the magnitude of a transmission coefficient depending on the longitudinal length of the first-type transmitting surface unit cells for radio waves incident at 0° or 15° in a TE mode.

Referring to FIG. 3B, Graph 310 shows the magnitude and phase of a transmission coefficient when feed radio waves are incident on the first-type transmitting surface unit cells at 35° or 40° in a TE mode.

For example, in Graph 310, the solid lines may represent changes in the magnitude of a transmission coefficient depending on the longitudinal length of the first-type transmitting surface unit cells for radio waves incident at 35° or 40° in a TE mode.

In addition, in Graph 310, the dotted lines may represent changes in the magnitude of a transmission coefficient depending on the longitudinal length of the first-type transmitting surface unit cells for radio waves incident at 35° or 40° in a TE mode.

Referring to FIG. 3C, Graph 320 shows the magnitude and phase of a transmission coefficient when feed radio waves are incident on the first-type transmitting surface unit cells at 45° or 50° in a TE mode.

For example, in Graph 320, the solid lines may represent changes in the magnitude of a transmission coefficient depending on the longitudinal length of the first-type transmitting surface unit cells for radio waves incident at 45° or 50° in a TE mode.

In addition, in Graph 320, the dotted lines may represent changes in the magnitude of a transmission coefficient depending on the longitudinal length of the first-type transmitting surface unit cells for radio waves incident at 45° or 50° in a TE mode.

Referring to FIG. 3D, Graph 330 shows the magnitude and phase of a transmission coefficient when feed radio waves are incident on the first-type transmitting surface unit cells at 55° or 60° in a TE mode.

For example, in Graph 330, the solid lines may represent changes in the magnitude of a transmission coefficient depending on the longitudinal length of the first-type transmitting surface unit cells for radio waves incident at 55° or 60° in a TE mode.

In addition, in Graph 330, the dotted lines may represent changes in the magnitude of a transmission coefficient depending on the longitudinal length of the first-type transmitting surface unit cells for radio waves incident at 55° or 60° in a TE mode.

FIGS. 4A to 4D are graphs showing the magnitude and phase of a transmission coefficient depending on an incidence angle when feed radio waves are incident on first-type transmitting surface unit cells according to one embodiment of the present disclosure at an oblique angle in a TM mode.

Referring to FIG. 4A, Graph 400 shows the magnitude and phase of a transmission coefficient when feed radio waves are incident on the first-type transmitting surface unit cells at 0° or 15° in a TM mode.

For example, in Graph 400, the solid lines may represent changes in the magnitude of a transmission coefficient depending on the longitudinal length of the first-type transmitting surface unit cells for radio waves incident at 0° or 15° in a TM mode.

In addition, in Graph 400, the dotted lines may represent changes in the magnitude of a transmission coefficient depending on the longitudinal length of the first-type transmitting surface unit cells for radio waves incident at 0° or 15° in a TM mode.

Referring to FIG. 4B, Graph 410 shows the magnitude and phase of a transmission coefficient when feed radio waves are incident on the first-type transmitting surface unit cells at 35° or 40° in a TM mode.

For example, in Graph 410, the solid lines may represent changes in the magnitude of a transmission coefficient depending on the longitudinal length of the first-type transmitting surface unit cells for radio waves incident at 35° or 40° in a TM mode.

In addition, in Graph 410, the dotted lines may represent changes in the magnitude of a transmission coefficient depending on the longitudinal length of the first-type transmitting surface unit cells for radio waves incident at 35° or 40° in a TM mode.

Referring to FIG. 4C, Graph 420 shows the magnitude and phase of a transmission coefficient when feed radio waves are incident on the first-type transmitting surface unit cells at 45° or 50° in a TM mode.

For example, in Graph 420, the solid lines may represent changes in the magnitude of a transmission coefficient depending on the longitudinal length of the first-type transmitting surface unit cells for radio waves incident at 45° or 50° in a TM mode.

In addition, in Graph 420, the dotted lines may represent changes in the magnitude of a transmission coefficient depending on the longitudinal length of the first-type transmitting surface unit cells for radio waves incident at 45° or 50° in a TM mode.

Referring to FIG. 4D, Graph 430 shows the magnitude and phase of a transmission coefficient when feed radio waves are incident on the first-type transmitting surface unit cells at 55° or 60° in a TM mode.

For example, in Graph 430, the solid lines may represent changes in the magnitude of a transmission coefficient depending on the longitudinal length of the first-type transmitting surface unit cells for radio waves incident at 55° or 60° in a TM mode.

In addition, in Graph 430, the dotted lines may represent changes in the magnitude of a transmission coefficient depending on the longitudinal length of the first-type transmitting surface unit cells for radio waves incident at 55° or 60° in a TM mode.

FIGS. 5A to 5D are graphs showing the magnitude and phase of a transmission coefficient depending on an incidence angle when feed radio waves are incident on second-type transmitting surface unit cells according to one embodiment of the present disclosure at an oblique angle in a TE mode.

Referring to FIG. 5A, Graph 500 shows the magnitude and phase of a transmission coefficient when feed radio waves are incident on the second-type transmitting surface unit cells at 0° or 15° in a TE mode.

For example, in Graph 500, the solid lines may represent changes in the magnitude of a transmission coefficient depending on the longitudinal length of the second-type transmitting surface unit cells for radio waves incident at 0° or 15° in a TE mode.

In addition, in Graph 500, the dotted lines may represent changes in the magnitude of a transmission coefficient depending on the longitudinal length of the second-type transmitting surface unit cells for radio waves incident at 0° or 15° in a TE mode.

Referring to FIG. 5B, Graph 510 shows the magnitude and phase of a transmission coefficient when feed radio waves are incident on the second-type transmitting surface unit cells at 35° or 40° in a TE mode.

For example, in Graph 510, the solid lines may represent changes in the magnitude of a transmission coefficient depending on the longitudinal length of the second-type transmitting surface unit cells for radio waves incident at 35° or 40° in a TE mode.

In addition, in Graph 510, the dotted lines may represent changes in the magnitude of a transmission coefficient depending on the longitudinal length of the second-type transmitting surface unit cells for radio waves incident at 35° or 40° in a TE mode.

Referring to FIG. 5C, Graph 520 shows the magnitude and phase of a transmission coefficient when feed radio waves are incident on the second-type transmitting surface unit cells at 45° or 50° in a TE mode.

For example, in Graph 520, the solid lines may represent changes in the magnitude of a transmission coefficient depending on the longitudinal length of the second-type transmitting surface unit cells for radio waves incident at 45° or 50° in a TE mode.

In addition, in Graph 520, the dotted lines may represent changes in the magnitude of a transmission coefficient depending on the longitudinal length of the second-type transmitting surface unit cells for radio waves incident at 45° or 50° in a TE mode.

Referring to FIG. 5D, Graph 530 shows the magnitude and phase of a transmission coefficient when feed radio waves are incident on the second-type transmitting surface unit cells at 55° or 60° in a TE mode.

For example, in Graph 530, the solid lines may represent changes in the magnitude of a transmission coefficient depending on the longitudinal length of the second-type transmitting surface unit cells for radio waves incident at 55° or 60° in a TE mode.

In addition, in Graph 530, the dotted lines may represent changes in the magnitude of a transmission coefficient depending on the longitudinal length of the second-type transmitting surface unit cells for radio waves incident at 55° or 60° in a TE mode.

FIGS. 6A to 6D are graphs showing the magnitude and phase of a transmission coefficient depending on an incidence angle when feed radio waves are incident on second-type transmitting surface unit cells according to one embodiment of the present disclosure at an oblique angle in a TM mode.

Referring to FIG. 6A, Graph 600 shows the magnitude and phase of a transmission coefficient when feed radio waves are incident on the second-type transmitting surface unit cells at 0° or 15° in a TM mode.

For example, in Graph 600, the solid lines may represent changes in the magnitude of a transmission coefficient depending on the longitudinal length of the second-type transmitting surface unit cells for radio waves incident at 0° or 15° in a TM mode.

In addition, in Graph 600, the dotted lines may represent changes in the magnitude of a transmission coefficient depending on the longitudinal length of the second-type transmitting surface unit cells for radio waves incident at 0° or 15° in a TM mode.

Referring to FIG. 6B, Graph 610 shows the magnitude and phase of a transmission coefficient when feed radio waves are incident on the second-type transmitting surface unit cells at 35° or 40° in a TM mode.

For example, in Graph 610, the solid lines may represent changes in the magnitude of a transmission coefficient depending on the longitudinal length of the second-type transmitting surface unit cells for radio waves incident at 35° or 40° in a TM mode.

In addition, in Graph 610, the dotted lines may represent changes in the magnitude of a transmission coefficient depending on the longitudinal length of the second-type transmitting surface unit cells for radio waves incident at 35° or 40° in a TM mode.

Referring to FIG. 6C, Graph 620 shows the magnitude and phase of a transmission coefficient when feed radio waves are incident on the second-type transmitting surface unit cells at 45° or 50° in a TM mode.

For example, in Graph 620, the solid lines may represent changes in the magnitude of a transmission coefficient depending on the longitudinal length of the second-type transmitting surface unit cells for radio waves incident at 45° or 50° in a TM mode.

In addition, in Graph 620, the dotted lines may represent changes in the magnitude of a transmission coefficient depending on the longitudinal length of the second-type transmitting surface unit cells for radio waves incident at 45° or 50° in a TM mode.

Referring to FIG. 6D, Graph 630 shows the magnitude and phase of a transmission coefficient when feed radio waves are incident on the second-type transmitting surface unit cells at 55° or 60° in a TM mode.

For example, in Graph 630, the solid lines may represent changes in the magnitude of a transmission coefficient depending on the longitudinal length of the second-type transmitting surface unit cells for radio waves incident at 55° or 60° in a TM mode.

In addition, in Graph 630, the dotted lines may represent changes in the magnitude of a transmission coefficient depending on the longitudinal length of the second-type transmitting surface unit cells for radio waves incident at 55° or 60° in a TM mode.

FIG. 7 is a drawing for explaining incidence angles in transmitting surface unit cells according to one embodiment of the present disclosure.

Referring to FIG. 7, a transmitarray antenna 700 according to one embodiment of the present disclosure may receive feed radio waves in a TM mode and feed radio waves in a TE mode from a feed antenna. In this case, each of a plurality of regions may receive feed radio waves of different incidence angles.

According to one embodiment of the present disclosure, the incidence angle of radio waves transmitted to the transmitarray antenna 700 from a feed antenna may be gradually increased from 0° to 60° from the central portion of the regions to the outer portion of the regions.

For example, radio waves having an incidence angle of 15° in a TM mode and in a TE mode may be transmitted to four regions located in the central portion of the transmitarray antenna 700, and radio waves having an incidence angle of 60° in a TM mode and in a TE mode may be transmitted to regions located in the outer portion.

For example, the transmitarray antenna 700 and the feed antenna may be separated by a distance of 1.2 wavelengths.

That is, in the transmitarray antenna 700, each region receives radio waves of different incidence angles. When a plurality of transmitting surface unit cells having different characteristics is arranged, the efficiency of the transmitarray antenna 700 may be increased.

FIG. 8 is a drawing for explaining the phase of a transmission coefficient required for formation of an output phase associated with the maximum gain in transmitting surface unit cells according to one embodiment of the present disclosure.

FIG. 8 shows the phases of a transmission coefficient required to integrate output phases to 0° in the transmitarray antenna.

Referring to FIG. 8, a transmitarray antenna 800 according to one embodiment of the present disclosure may receive feed radio waves in a TM mode and feed radio waves in a TE mode from a feed antenna. In this case, different phases of a transmission coefficient may be required in each of a plurality of regions.

For example, the regions of the transmitarray antenna 800 may be divided into a TM mode and a TE mode, and the number of phases of the transmission coefficient required in each region may be 3 or less.

The coefficients of a transmission phase required to form an output phase of 0 in the transmitarray antenna 800 are shown in Table 1 below.

TABLE 1

| | Incidence angle | | |
|---|---|---|---|
| Mode | TE mode | TM mode | TE & TM modes |
| 15° | — | — | 70° |
| 35° | 135° | 128° | — |
| 40° | — | — | 189° |
| 45° | 245° | 233° | — |
| 50° | 293° | 284° | — |
| 55° | 20°, 61° | 9°, 54° | 18° |
| 60° | 136°, 171° | 134°, 161° | — |

For example, when radio waves are incident on the transmitting surface unit cells of the transmitarray antenna 800 at an incidence angle of 15°, the coefficient of a transmission phase required to form an output phase of 0° may be 70° regardless of mode.

Here, with respect to the output phase of radio waves passing through the transmitarray antenna 800, the coefficient of a transmission phase for improving the transmission efficiency of the transmitarray antenna may be calculated based on Equation 1 below, and the coefficient of the transmission phase may be compensated based on the calculation result.

$$\text{Required } S_{21} \text{ phase} = -\text{input phase} + \alpha \quad \text{[Equation 1]}$$

In Equation 1, "Required $S_{21}$ phase" may represent the coefficient of a transmission phase, "input phase" may represent an input phase, and "α" may represent an angle for compensating the coefficient of a transmission phase between an input phase and an output phase and "α" may correspond to an output phase.

Accordingly, the phase of a transmission coefficient may be calculated based on the combination of an output phase and the negative value of an input phase.

Based on the phase of a transmission coefficient in the transmitarray antenna 800, the magnitude of a transmission coefficient based on the first-type transmitting surface unit cells and the second-type transmitting surface unit cells may be calculated based on the measurement data shown in the graphs of FIGS. 3A to 6D, and the results are shown in Table 2 below. Here, "α" may be 61°.

TABLE 2

| Incidence angle-Mode | Phase of transmission coefficient (Required phase of $S_{21}$) | First type-TE | Second type-TE | First type-TM | Second type-TM |
|---|---|---|---|---|---|
| 15°-TE&TM | 131° | −0.13 dB | −0.15 dB | −0.12 dB | −0.14 dB |
| 35°-TE | −164° | −0.2 dB | −0.74 dB | — | — |
| 35°-TM | −171° | — | — | −0.29 dB | −0.52 dB |
| 40°-TE&TM | −110° | −0.24 dB | −0.43 dB | −0.65 dB | −0.14 dB |
| 45°-TE | −54° | −2.44 dB | −1 dB | — | — |
| 45°-TM | −66° | — | — | −2.87 dB | −1.48 dB |

TABLE 2-continued

| Incidence angle-Mode | Phase of transmission coefficient (Required phase of $S_{21}$) | First type-TE | Second type-TE | First type-TM | Second type-TM |
|---|---|---|---|---|---|
| 50°-TE | −6° | −1.57 dB | −0.83 dB | — | — |
| 50°-TM | −15° | — | — | 1.45 dB | −1.61 dB |
| 55°-TE | 81° | −0.73 dB | −2.79 dB | — | — |
| | 122° | −0.9 dB | −1.71 dB | — | — |
| 55°-TM | 70° | — | — | −0.24 dB | −0.24 dB |
| | 115° | −0.7 dB | −2.71 dB | −0.2 dB | −0.24 dB |
| 55°-TE&TM | 79° | −0.7 dB | −2.71 dB | −0.27 dB | −0.31 dB |
| 60°-TE | −163° | −0.07 dB | −0.52 dB | — | — |
| | −128° | −0.35 dB | −1.52 dB | — | — |
| 60°-TM | −165° | — | — | −0.03 dB | −0.1 dB |
| | −138° | — | — | −0.09 dB | −0.06 dB |

Referring to Table 2, when a first-type transmitting surface unit cell, which is any one of a plurality of transmitting surface unit cells, has an incidence angle of 0° to 60° in a transverse electric (TE) mode, the first-type transmitting surface unit cell may exhibit a transmission coefficient of −0.13 dB to −2.44 dB depending on the phase of the transmission coefficient. When a first-type transmitting surface unit cell has an incidence angle of 0° to 60° in a transverse magnetic (TM) mode, the first-type transmitting surface unit cell may exhibit a transmission coefficient of −0.03 dB to −2.87 dB depending on the phase of the transmission coefficient.

In addition, when a second-type transmitting surface unit cell, which is any one of a plurality of transmitting surface unit cells, has an incidence angle of 0° to 60° in a transverse electric (TE) mode, the second-type transmitting surface unit cell may exhibit a transmission coefficient of −0.15 dB to −2.44 dB depending on the phase of the transmission coefficient. When a second-type transmitting surface unit cell has an incidence angle of 0° to 60° in a transverse magnetic (TM) mode, the second-type transmitting surface unit cell may exhibit a transmission coefficient of −0.06 dB to −1.61 dB depending on the phase of the transmission coefficient.

FIG. 9A shows a design structure of a transmitarray antenna according to one embodiment of the present disclosure.

Referring to FIG. 9A, in a transmitarray antenna 900, first-type transmitting surface unit cells 910 and second-type transmitting surface unit cells 920 may be arranged in a mixed manner.

According to one embodiment of the present disclosure, the transmitarray antenna 900 includes a plurality of transmitting surface unit cells having different surface structures and different longitudinal lengths located in a plurality of regions.

For example, the transmitting surface unit cells may include the first-type transmitting surface unit cells 910 and the second-type transmitting surface unit cells 920.

According to one embodiment of the present disclosure, the transmitting surface unit cells may be arranged in a mixed manner in the regions of the transmitarray antenna 900 based on the different longitudinal lengths and the phase of a transmission coefficient determined based on an input phase and an output phase based on the mode and incidence angle of radio waves transmitted from a feed antenna.

That is, any one of the transmitting surface unit cells may be selectively arranged in any one of the regions based on the magnitude and phase of a transmission coefficient depending on the mode and incidence angle of radio waves transmitted from the feed antenna.

Accordingly, according to the present disclosure, by selectively arranging the transmitting surface unit cells having different characteristics or different longitudinal lengths, the efficiency of the transmitarray antenna may be increased while reducing the overall size of the antenna.

For example, each of the first-type transmitting surface unit cells 910 may have a longitudinal length of 9 mm to 10 mm, and each of the second-type transmitting surface unit cells 920 may have a longitudinal length of 1.6 mm to 1.8 mm.

FIG. 9B is a drawing for explaining the radiation patterns of a transmitarray antenna according to one embodiment of the present disclosure.

Referring to FIG. 9B, Graph 930 shows radiation patterns. The radiation pattern of the solid line may be associated with a first-type transmitting surface unit cell, and the radiation pattern of the dotted line may be associated with a second-type transmitting surface unit cell.

According to one embodiment of the present disclosure, in the radiation patterns of Graph 930, the longitudinal lengths of the first-type transmitting surface unit cell and the longitudinal lengths of the second-type transmitting surface unit cell are shown in Table 3 below.

TABLE 3

| Incidence angle-Mode | Angle of radiation pattern | First type | Second type |
|---|---|---|---|
| 15°-TEM | 90° | 10.05 mm | 1.77 mm |
| 35°-TE | 155° | 9.29 mm | 1.64 mm |
| 35°-TM | 148° | 9.46 mm | 1.63 mm |
| 40°-TEM | 209° | 8.98 mm | 1.52 mm |
| 45°-TE | 265° | 8.59 mm | 1.48 mm |
| 45°-TM | 253° | 12.89 mm | 1.43 mm |
| 50°-TE | 313° | 11.91 mm | 2.11 mm |
| 50°-TM | 304° | 12.69 mm | 2.37 mm |
| 55°-TE | 40° | 11.17 mm | 1.93 mm |
| 55°-TE | 81° | 10.58 mm | 1.8 mm |
| 55°-TM | 29° | 12.2 mm | 2.23 mm |
| 55°-TM | 74° | 11.54 mm | 2.05 mm |
| 55°-TEM | 38° | 12.54 mm | 2.07 mm |
| 60°-TE | 156° | 9.54 mm | 1.66 mm |
| 60°-TE | 191° | 8.96 mm | 1.59 mm |
| 60°-TM | 154° | 9.95 mm | 1.74 mm |
| 60°-TM | 181° | 9.42 mm | 1.63 mm |

According to one embodiment of the present disclosure, the gain of the transmitarray antenna may be 19.7 dBi and the aperture efficiency thereof may be 43.2%. Based on these results, it can be seen that, in the case of the transmitarray antenna, the ratio of the distance between a transmitting surface and a feed antenna to the diameter of the transmitting surface is 0.24, and thus the transmitarray antenna is a low-profile transmitarray antenna having high efficiency.

That is, the present disclosure may improve the radiation efficiency of a transmitarray antenna by selecting transmitting surface unit cells having excellent performance with respect to the incident characteristics of feed radio waves among transmitting surface unit cells having different characteristics or longitudinal lengths and by arranging the selected transmitting surface unit cells in a mixed manner.

FIG. 10 is a flowchart for explaining a method of designing a transmitarray antenna according to one embodiment of the present disclosure.

Referring to FIG. 10, according to a method of designing a transmitarray antenna, in Step 1001, an input phase is calculated.

That is, according to the method of designing a transmitarray antenna, an input phase may be calculated based on the mode and incidence angle of radio waves transmitted from a feed antenna.

In Step 1002, an output phase is calculated.

That is, in Step 1001, an output phase may be calculated based on the calculated input phase. In this case, an output phase may be calculated to integrate output phases to 0° based on the input phase. In this case, the calculated output phase may correspond to "α" of Equation 1.

In Step 1003, the phase of a transmission coefficient is calculated.

That is, according to the method of designing a transmitarray antenna, the phase of a transmission coefficient is calculated by combining an output phase and the negative value of an input phase. In this case, the phase of a transmission coefficient may be the phase of a transmission coefficient required to integrate output phases to 0°.

In Step 1004, transmitting surface unit cells are selected and arranged based on the phase of a transmission coefficient.

That is, according to the method of designing a transmitarray antenna, based on the calculated phase of a transmission coefficient in Step 1003, a plurality of transmitting surface unit cells having different surface structures and different longitudinal lengths may be selected and the selected transmitting surface unit cells may be arranged in a mixed manner in a plurality of regions.

That is, according to the present disclosure, transmitting surface unit cells having different characteristics in accordance with change in the characteristics of a transmitting surface depending on the mode and incidence angle of feed radio waves may be arranged in a mixed manner.

According to the present disclosure, transmitting surface unit cells having different characteristics in accordance with change in the characteristics of a transmitting surface depending on the mode and incidence angle of feed radio waves can be arranged in a mixed manner.

According to the present disclosure, when a low-profile transmitarray antenna is designed, performance degradation of transmitting surface unit cells located in the transmitting surface of a transmitarray antenna depending on the mode and incidence angle of feed radio waves can be prevented, thereby improving the efficiency of the transmitarray antenna.

According to the present disclosure, the radiation efficiency of a transmitarray antenna can be improved by selecting transmitting surface unit cells having excellent performance with respect to the incident characteristics of feed radio waves among transmitting surface unit cells having different characteristics or longitudinal lengths and by arranging the selected transmitting surface unit cells in a mixed manner.

According to the present disclosure, the efficiency of a transmitarray antenna can be increased while reducing the overall size of the antenna by selectively arranging a plurality of transmitting surface unit cells having different characteristics or longitudinal lengths.

Although the present disclosure has been described with reference to limited embodiments and drawings, it should be understood by those skilled in the art that various changes and modifications may be made therein. For example, the described techniques may be performed in a different order than the described methods, and/or components of the described systems, structures, devices, circuits, etc., may be combined in a manner that is different from the described method, or appropriate results may be achieved even if replaced by other components or equivalents.

Therefore, other embodiments, other examples, and equivalents to the claims are within the scope of the following claims.

DESCRIPTION OF SYMBOLS

100: TRANSMITARRAY ANTENNA SYSTEM
110: FEED ANTENNA
120: TRANSMITARRAY ANTENNA
121: INPUT PHASE
122: PHASE CHANGE
123: OUTPUT PHASE
200: FIRST-TYPE TRANSMITTING SURFACE UNIT CELL
210: SECOND-TYPE TRANSMITTING SURFACE UNIT CELL

What is claimed is:

1. A transmitarray antenna comprising:

a plurality of transmitting surface unit cells having different surface structures and different longitudinal lengths located in a plurality of regions, wherein the transmitarray antenna is configured to receive radio waves from a feed antenna spaced apart from the transmitarray antenna, wherein the plurality of transmitting surface unit cells are arranged in a mixed manner in the regions based on the different longitudinal lengths and a phase of a transmission coefficient determined based on an input phase of the radio waves and an output phase of the radio waves based on a mode of the radio waves and an incidence angle of the radio waves, wherein the mode of the radio waves includes a transverse electric (TE) mode or a transverse magnetic (TM) mode, and wherein the plurality of transmitting surface unit cells are arranged in the mixed manner such that any one of the plurality of transmitting surface unit cells exhibits a transmission coefficient of −0.13 dB to −2.44 dB depending on the phase of the transmission coefficient when the incidence angle of the radio waves is in a range of 0° to 60° in the transverse electric (TE) mode, and the any one of the plurality of transmitting surface unit cells exhibits a transmission coefficient of −0.03 dB to −2.87 dB depending on the phase of the transmission coefficient when the incidence angle of the radio waves is in the range of 0° to 60° in the transverse magnetic (TM) mode.

2. The transmitarray antenna according to claim 1, wherein any one of the transmitting surface unit cells is selectively arranged in any one of the regions based on a magnitude of the transmission coefficient and the phase of the transmission coefficient depending on the mode of the radio waves and the incidence angle of the radio waves.

3. The transmitarray antenna according to claim 1, wherein the transmitting surface unit cells are arranged in the mixed manner in a multilayer or single-layer form based on the mode of the radio waves and the incidence angle of the radio waves.

4. The transmitarray antenna according to claim 1, wherein the phase of the transmission coefficient is calculated based on a combination of the output phase and a negative value of the input phase.

5. The transmitarray antenna according to claim 1, wherein the incidence angle is gradually increased from 0° to 60° from a central portion of the regions to an outer portion of the regions.

6. A transmitarray antenna comprising:

a plurality of transmitting surface unit cells having different surface structures and different longitudinal lengths located in a plurality of regions, wherein the transmitarray antenna is configured to receive radio waves from a feed antenna spaced apart from the transmitarray antenna, wherein the plurality of transmitting surface unit cells are arranged in a mixed manner in the regions based on the different longitudinal lengths and a phase of a transmission coefficient determined based on an input phase of the radio waves and an output phase of the radio waves based on a mode of the radio waves and an incidence angle of the radio waves, wherein the mode of the radio waves includes a transverse electric (TE) mode or a transverse magnetic (TM) mode, and wherein the plurality of transmitting surface unit cells are arranged in the mixed manner such that any one of the plurality of transmitting surface unit cells exhibits a transmission coefficient of −0.15 dB to −2.44 dB depending on the phase of the transmission coefficient when the incidence angle of the radio waves is in a range of 0° to 60° in the transverse electric (TE) mode and the any one of the transmitting surface unit cells exhibits a transmission coefficient of −0.06 dB to −1.61 dB depending on the phase of the transmission coefficient when the incidence angle of the radio waves is in the range of 0° to 60° in the transverse magnetic (TM) mode.

7. The transmitarray antenna according to claim 6, wherein any one of the transmitting surface unit cells has a longitudinal length of 9 mm to 10 mm, and the other of the transmitting surface unit cells has a longitudinal length of 1.6 mm to 1.8 mm.

8. A method of designing a transmitarray antenna including a memory configured to store computer-readable instructions and one or more processors configured to execute the computer-readable instructions, the method comprising:

calculating, by the one or more processors, an input phase of radio waves transmitted from a feed antenna based on a mode of the radio waves and an incidence angle of the radio waves;

calculating, by the one or more processors, an output phase of the radio waves based on the calculated input phase;

calculating, by the one or more processors, a phase of a transmission coefficient by combining the calculated output phase and a negative value of the calculated input phase; and selecting a plurality of transmitting surface unit cells having different surface structures and different longitudinal lengths and arranging the plurality of transmitting surface unit cells in a mixed manner in the regions based on the calculated phase of the transmission coefficient, wherein the mode of the radio waves includes a transverse electric (TE) mode or a transverse magnetic (TM) mode, and wherein the arranging comprises arranging the plurality of transmitting surface unit cells in the mixed manner such that any one of the plurality of transmitting surface unit cells exhibits a transmission coefficient of −0.13 dB to −2.44 dB depending on a phase of the transmission coefficient when the incidence angle of the radio waves is in a range of 0° to 60° in the transverse electric (TE) mode, and the any one of the plurality of transmitting surface unit cells exhibits a transmission coefficient of −0.03 dB to −2.87 dB depending on a phase of the transmission coefficient when the incidence angle of the radio waves is in the range of 0° to 60° in the transverse magnetic (TM) mode.

9. The method according to claim 8, wherein the arranging comprises arranging transmitting surface unit cells having a longitudinal length shorter than a reference length among the transmitting surface unit cells in a central portion of the regions based on the calculated phase of the transmission coefficient; and arranging transmitting surface unit cells having a longitudinal length longer than a reference length among the transmitting surface unit cells in an outer portion of the regions based on the calculated phase of the transmission coefficient.

10. The method according to claim 8, wherein the arranging comprises selecting any one of the transmitting surface unit cells according to the calculated phase of the transmission coefficient and a magnitude of the transmission coefficient based on the different longitudinal lengths and arranging the selected transmitting surface unit cell in the mixed manner in the regions.

* * * * *